US010407199B2

(12) United States Patent
van Wandelen et al.

(10) Patent No.: US 10,407,199 B2
(45) Date of Patent: Sep. 10, 2019

(54) PACKAGING APPARATUS WITH PACKAGE DIVIDING SEAL MECHANISM

(71) Applicant: CVP Systems LLC, Elgin, IL (US)

(72) Inventors: Christiaan J. van Wandelen, Naperville, IL (US); Christopher Duszka, Mokena, IL (US); Nicholas M. Baran, Plainfield, IL (US)

(73) Assignee: CVP Systems LLC, Elgin, IL (US)

( * ) Notice: Subject to any disclaimer, the term of this patent is extended or adjusted under 35 U.S.C. 154(b) by 545 days.

(21) Appl. No.: 14/838,815

(22) Filed: Aug. 28, 2015

(65) Prior Publication Data

US 2017/0057671 A1 Mar. 2, 2017

(51) Int. Cl.

| | |
|---|---|
| ***B65B 61/06*** | (2006.01) |
| ***B65B 9/093*** | (2012.01) |
| ***B26D 1/08*** | (2006.01) |
| ***B26D 9/00*** | (2006.01) |
| ***B26F 1/18*** | (2006.01) |
| *B26D 1/00* | (2006.01) |

(52) U.S. Cl.

CPC ..... *B65B 61/06* (2013.01); *B26D 1/085* (2013.01); *B26D 9/00* (2013.01); *B26F 1/18* (2013.01); *B65B 9/093* (2013.01); *B26D 2001/0053* (2013.01)

(58) Field of Classification Search

None

See application file for complete search history.

(56) References Cited

U.S. PATENT DOCUMENTS

| | | | | |
|---|---|---|---|---|
| 3,359,703 | A | 12/1967 | Quaadgras | |
| 4,662,147 | A | 5/1987 | Scheja | |
| 4,759,433 | A | 7/1988 | Kraft | |
| 5,187,917 | A * | 2/1993 | Mykleby | B65B 31/06 53/434 |

(Continued)

FOREIGN PATENT DOCUMENTS

| | | |
|---|---|---|
| CA | 1244496 | 11/1988 |
| EP | 1369826 A1 | 12/2003 |

(Continued)

OTHER PUBLICATIONS

International Searching Authority (ISA/PCT/EP) International Search Report of PCT Application No. PCT/GB2010/050675 dated Aug. 20, 2010; 3 pages.

*Primary Examiner* — Michelle Lopez
*Assistant Examiner* — Chinyere J Rushing-Tucker
(74) *Attorney, Agent, or Firm* — Brinks Gilson & Lione

(57) ABSTRACT

Packaging apparatuses for loading and sealing products into a web of interconnected bags, and methods of using them, are provided. In one aspect, the packaging apparatus includes an intermittently advancing web conveyor that also indexes vertically to facilitate stacked loading of products into the bags. In another aspect, the packaging apparatus includes a dividing seal station that applies a center seal dividing the bag into separate sealed subcompartments, some of the bag contents being distributed to each compartment, such as one of two trays to each subcompartment. To facilitate distribution of contents and even sealing, the dividing seal station may include a dividing sealer lower support that oscillates vertically to promote settling of contents and gases in the bag before applying a dividing seal.

14 Claims, 18 Drawing Sheets

(56) References Cited

U.S. PATENT DOCUMENTS

| | | | | |
|---|---|---|---|---|
| 5,235,794 | A | 8/1993 | Center | |
| 5,772,565 | A | 6/1998 | Weyandt | |
| 6,006,505 | A | 12/1999 | Natterer | |
| 7,448,185 | B2 | 11/2008 | Zeedyk et al. | |
| 7,712,290 | B2 | 5/2010 | Imao | |
| 8,001,749 | B2 | 8/2011 | Negele | |
| 2001/0011445 | A1* | 8/2001 | Scolaro | B65B 31/021 53/433 |
| 2005/0121099 | A1* | 6/2005 | Hansen | B65B 9/087 141/10 |
| 2011/0036058 | A1* | 2/2011 | Howdeshell, II | B26D 1/0006 53/419 |
| 2011/0301006 | A1* | 12/2011 | Howell | B65D 33/2508 493/84 |
| 2012/0090271 | A1* | 4/2012 | Rearick | B65B 9/093 53/434 |
| 2013/0015228 | A1 | 1/2013 | Hada et al. | |
| 2014/0190125 | A1* | 7/2014 | Rearick | B65B 25/04 53/434 |
| 2014/0363102 | A1* | 12/2014 | Edwards | B65D 81/3266 383/37 |
| 2015/0175288 | A1* | 6/2015 | Alquati | B26D 7/2628 53/450 |

FOREIGN PATENT DOCUMENTS

| | | | |
|---|---|---|---|
| EP | 1413703 | A2 | 4/2004 |
| GB | 2352006 | | 1/2001 |
| WO | 2008151773 | A1 | 12/2008 |

* cited by examiner

PACKAGING APPARATUS WITH PACKAGE DIVIDING SEAL MECHANISM

FIELD OF THE INVENTION

The present invention relates to conveyorized packaging apparatuses. More particularly, it relates to packaging apparatuses for intermittently conveying a generally horizontal web of interconnected bags and loading and sealing one or more stacks of items into the bags, and/or loading and sealing items side-by-side in the bags, followed by applying a dividing seal to divide the bags into two subcompartments, each containing part of the items, and optionally cutting or perforating along the dividing seal to separate the two subcompartments, thus forming two smaller sealed bags.

BACKGROUND

Packaging apparatuses exist for loading and sealing food items into bags in a web of interconnected bags. One type of apparatus provides for inserting items into a bag having one open end, and then applying a seal to the open end to seal the items into the bag. Often, for efficient loading, it is desired to seal multiple items in a single bag. However, disadvantages include that more items in a bag means more time required to consume the contents once opened, as well as in some cases an undesirably large area footprint of the sealed bag.

A need therefore exists for a packaging apparatus that facilitates sealing multiple food items within one bag, while limiting the area footprint of the sealed bag and/or providing a way to maintain the freshness of food items that are not the first to be consumed when the sealed bag is opened.

SUMMARY OF THE INVENTION

According to an aspect of the invention, a packaging apparatus including a station for dividing bags ("dividing sealing station") filled and sealed by the apparatus into subcompartments, and optionally cutting or perforating along a dividing seal to form smaller separate or separable bags from the two subcompartments, is provided. The apparatus includes a web conveyor and a pair of opposed belts that cooperate to convey a web of flexible material (such as a suitable polymer film) including interconnected bags to be filled and sealed, the web having generally parallel proximal and distal edges extending along a longitudinal conveying direction. A pair of opposed belts is configured to grip a portion of a proximal longitudinal strip of the web between the opposed belts, the interconnected bags being joined together by the proximal longitudinal strip, and each bag comprising a continuous closure meeting the proximal longitudinal strip at an upline end and a downline end of the closure, said closure ends being spaced apart longitudinally to define an opening of the bag extending between the closure ends and upline and downline sides of the bag extending transversely across the web of film from the respective upline and downline closure ends. For example, the closure may be a continuous, generally U-shaped seal, or it may comprise two transverse side seals and a C-folded edge of the web extending between the side seals, to define upline, downline, and distal closed sides of the bag. A bag-loading mechanism of the apparatus is configured to insert a product load into one of the bags through the bag opening and deposit the material inside the bag. The web conveyor is typically a generally horizontal belt conveyor, configured to support a portion of the web located to one side of the gripped portion in a generally horizontal orientation, and to advance said portion of the web downline as the opposed belts advance the longitudinal strip of the web downline. A closure sealing station located downline of the bag loading mechanism is configured to seal said bag opening to form a sealed bag containing the inserted product load. The dividing seal station is disposed downline of the closure sealing station and comprises a heat seal bar and a lower seal support. The lower seal support is configured to move from a lowered position disposed below the web conveyor to a raised position in which the lower seal support lifts a central portion of the bag above the upline and downline sides of the bag, so that the bag is essentially draped over the lower seal support. This causes an upline portion of the inserted product load to fall away from the central portion of the bag towards the upline side of the bag and a downline portion of the inserted product load to fall away from the central portion of the bag towards the downline side of the bag. In addition, when the lower seal support is fully raised, the heat seal bar and lower seal support grip the central portion of the bag between them to create a center seal in the bag which divides the bag into two sealed subcompartments, namely, a sealed upline subcompartment containing said upline product portion and a sealed downline subcompartment containing said downline product portion.

The lower seal support may be further configured to oscillate vertically to promote separation of said upline and downline product load portions before engaging the heat seal bar to seal said bag central portion.

Typically, the heat seal bar comprises longitudinally spaced apart, parallel, transverse elongate heat seal bands, disposed to form longitudinally spaced apart, parallel, transverse elongate heat seals in the bag central portion.

Further, the apparatus may comprise a bag splitting knife mounted for vertical movement between a lowered position and a raised cutting position extending between the heat seal bands, so that when the bag is retained between the heat seal bar and the lower seal support and the bag splitting knife is moved to the raised cutting position, the bag splitting knife forms a continuous transverse cut in an unsealed strip of the bag extending between the heat seals across a transverse dimension of the bag. This separates the downline subcompartment from the upline subcompartment, to form two separate, smaller sealed bags from one larger sealed bag. The cutting movement of the bag splitting knife may be driven by a pneumatic cylinder, so that the bag splitting knife can be discharged from the lowered position to the cutting position by a pneumatic impulse delivered to the pneumatic cylinder. The bag splitting knife comprising a linear array of generally V-shaped teeth, each tooth of the array comprising a tip and a cutting edge tapering from the tip to a base wider than the tip, the cutting edges of the teeth meeting end-to-end at the bases of the teeth to form a continuous cutting edge of the bag splitting knife.

In one embodiment, the apparatus further comprises a bag splitting knife stop member movable between a disengaged position and an engaged position obstructing movement of the bag splitting knife past a raised perforating position. In the perforating position, an upper portion of each tooth penetrates the unsealed strip to form a perforation comprising a plurality of discontinuous cuts spaced apart along the unsealed strip. The raised perforating position is disposed at an elevation between the lowered position and the raised cutting position. Thus, when the bag splitting knife stop member is in the engaged position, the bag splitting knife can be discharged from the lowered position to the perforating position by a pneumatic impulse delivered to the pneumatic cylinder and is restrained from passing the perforating position by the bag splitting knife stop member.

The packaging apparatus may also comprise a bag separation tool configured to press (typically upwardly or downwardly) against a portion of said longitudinal strip connecting the bag gripped between the seal bars to an adjacent upline bag to separate the adjacent bags. A preformed perforation extending transversely across the longitudinal strip may facilitate separation by the separation tool. For example, the apparatus may comprise a pre-perforation knife adapted to form such a perforation, extending across the proximal longitudinal strip to a proximal end of each pair of adjacent free side edges of adjacent bags. The perforation may, for example, be formed before the proximal longitudinal strip is fed between the opposed belts.

According to another aspect of the invention, a stacked loading packaging apparatus is provided. Similarly to the apparatus described above, the stacked loading apparatus comprises a web conveyor cooperating with a pair of opposed belts to support and advance a web of flexible material comprising interconnected bags. A bag loader of the apparatus is configured to insert a generally horizontally oriented first item into one of the bags between the opposed belts through an opening of the bag at a loading height and deposit the first item inside said bag. The loading height is generally fixed, and a lift mechanism is provided to lower the web conveyor to permit the bag loader to insert again without impinging the previously deposited item. Thus, the lift mechanism may index downward in stepwise increments equal to approximately the thickness of a deposited item, in between successive insertions of the loader. These movements may be programmed into and coordinated by an electronic controller of the packaging apparatus. To facilitate insertion of the loader, the opposed belts may guide top and bottom plies of the web around a spreader bracket at a product infeed station, the spreader bracket being configured to expand to spread apart the plies of the web, typically at or near the proximal longitudinal strip, to form a vertical gap for insertion of the bag loader and supported item.

DETAILED DESCRIPTION OF THE INVENTION

With reference to the accompanying drawings, the structure and function of an automatic packaging apparatus 10 according to the present invention will now be described. Apparatus 10 embodies aspects of the present invention providing for loading stacked layers of products into bags on a conveyor and for forming a dividing seal in a bag on a conveyor to divide the bag into separately sealed subcompartments, which may be permanently connected, manually separable, or separated as desired. The illustrated packaging apparatus 10 also includes in-line bag making and modified atmosphere gas evacuation and replacement functions, described briefly herein. A more detailed description of such aspects of a packaging apparatus is provided in U.S. Pat. No. 8,689,529 and in U.S. patent application Ser. No. 14/202,952, the entire contents of which are hereby incorporated by reference. However, the present invention is not so limited. For example, the stacked loading and bag splitting/dividing aspects of the invention may be advantageously incorporated more generally in machines that load and seal products into bags of an interconnected, conveyorized web, regardless of whether the bags are formed in-line by the apparatus of the invention, formed in-line by a separate machine which feeds the web of bags to the apparatus of the invention, preformed on a roll, or otherwise fed into the inventive apparatus. Also, the invention is advantageously employed for loading, sealing, and forming compartments from bags in an interconnected web, regardless of whether they are evacuated and refilled with a replacement gas or gas mixture, evacuated only, or simply sealed without manipulating the gaseous environment to be sealed within the bags.

Figure 1A:
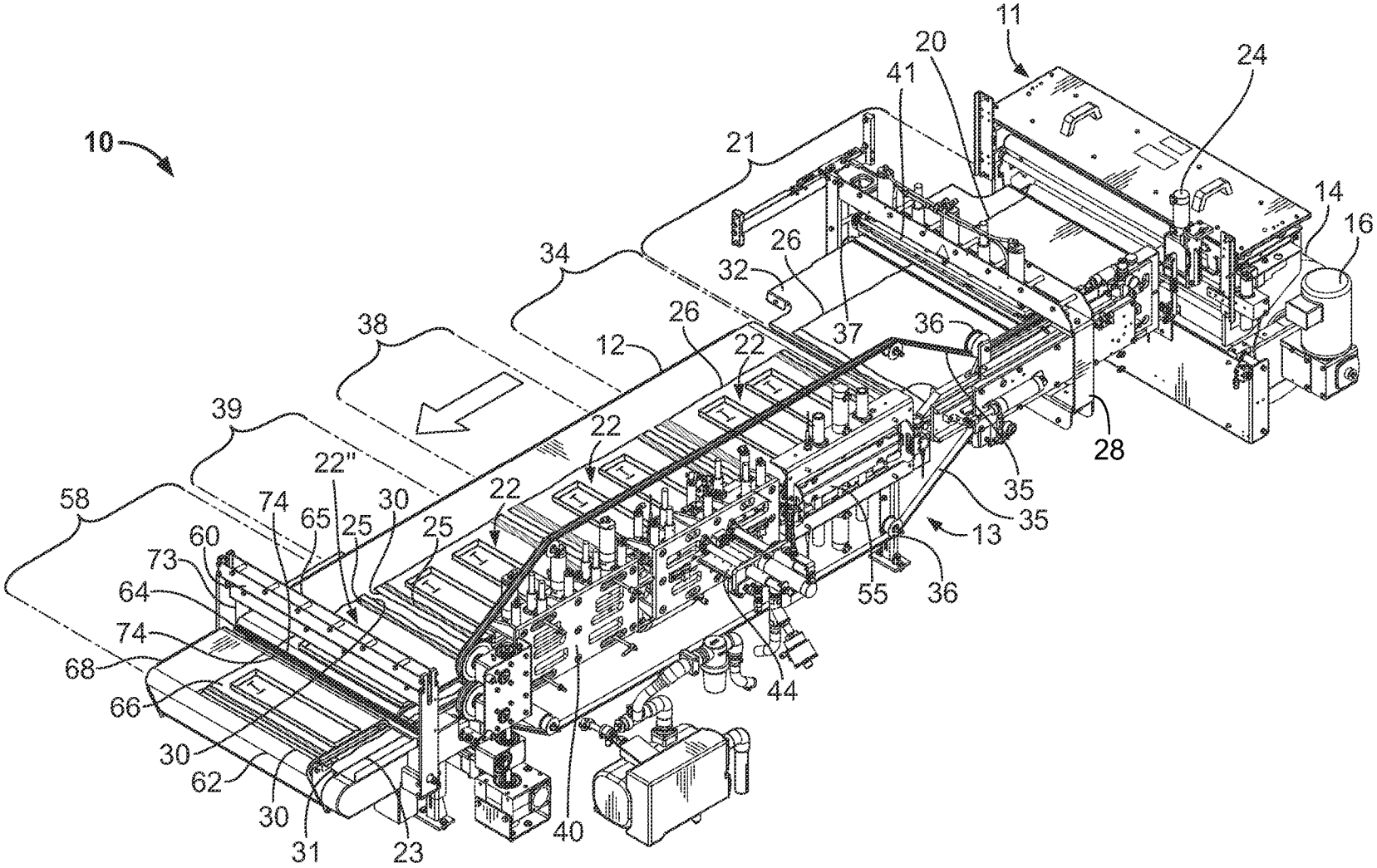
FIG. 1A is a perspective internal component layout view of a packaging apparatus according to the invention.

Turning to FIG. 1A, apparatus 10 includes a web feed assembly 11, a main web conveyor 12, and a timing belt assembly 13 cooperate to advance a flexible web 20 through apparatus 10, and a plurality of stations where web 20 is manipulated along its conveyorized path. Main web conveyor 12 is driven and operated by any appropriate means known within the art, and web feed assembly 11 feeds web 20 from a roll 14, either passively permitting web 20 to be pulled forward by main web conveyor 12 and timing belt assembly 13 or with the assistance of an unwind motor 16. Web 20 comprises a continuous, longitudinally folded ("C-folded") sheet of flexible material, which may for example be a 0.002-in thick polynylon film, having a distal folded edge 26, from which flexible bags 22 are formed in a bag-making station 21 of apparatus 10. Bag-making station 21 includes a pre-perforation assembly 24 for forming a pre-perforation 27 (shown in FIG. 1B) permitting adjoining bags 22 to be separated from one another, and an edge perforator-sealer 28 for forming side seals 25 and side edge cuts 30 of adjoining bags 22. One example of a suitable pre-perforation assembly 24 is described in U.S. Pat. No. 8,689,529.

Figure 1B:
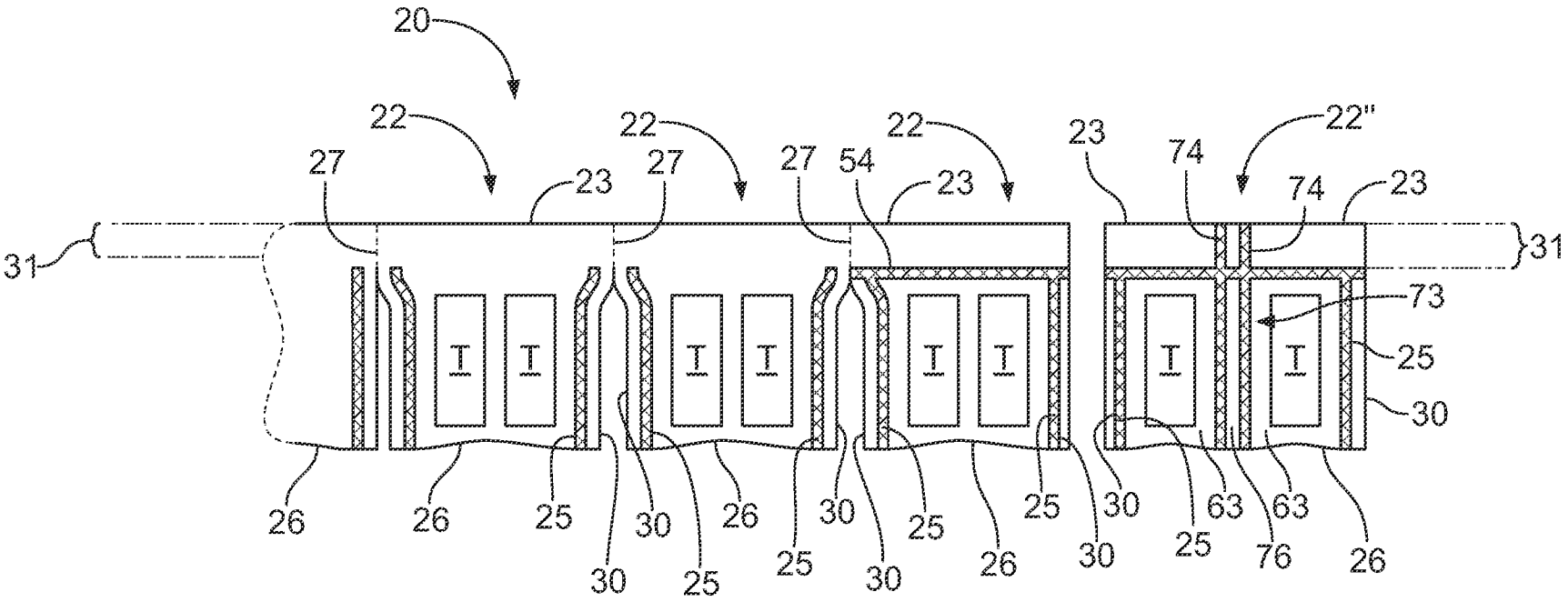
FIG. 1B is a schematic view of a web of bags for use in the packaging apparatus of FIG. 1A.
Figure 2:
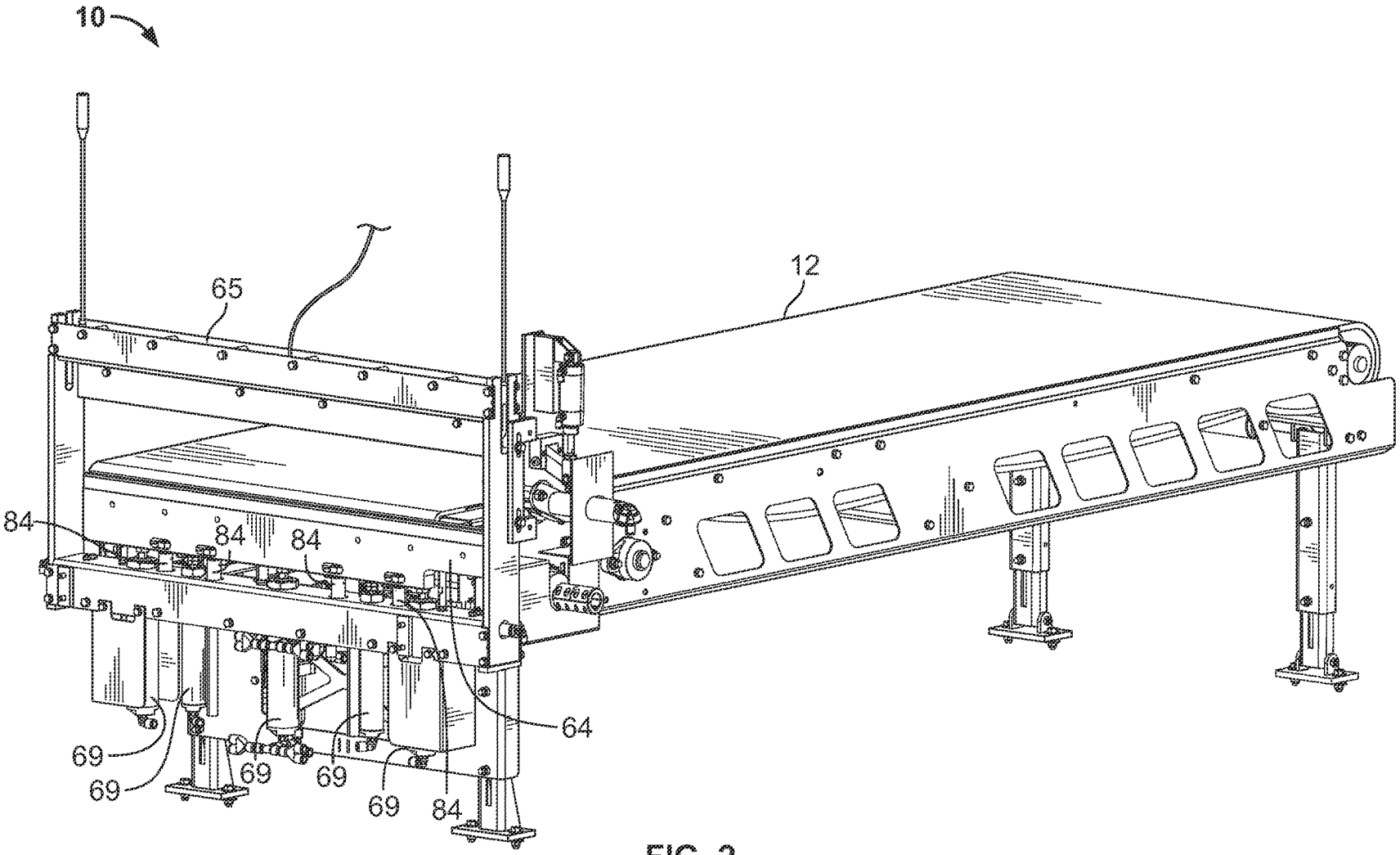
FIG. 2 is a perspective view of a main conveyor and dividing sealer of the packaging apparatus of FIG. 1A.
Figure 3:
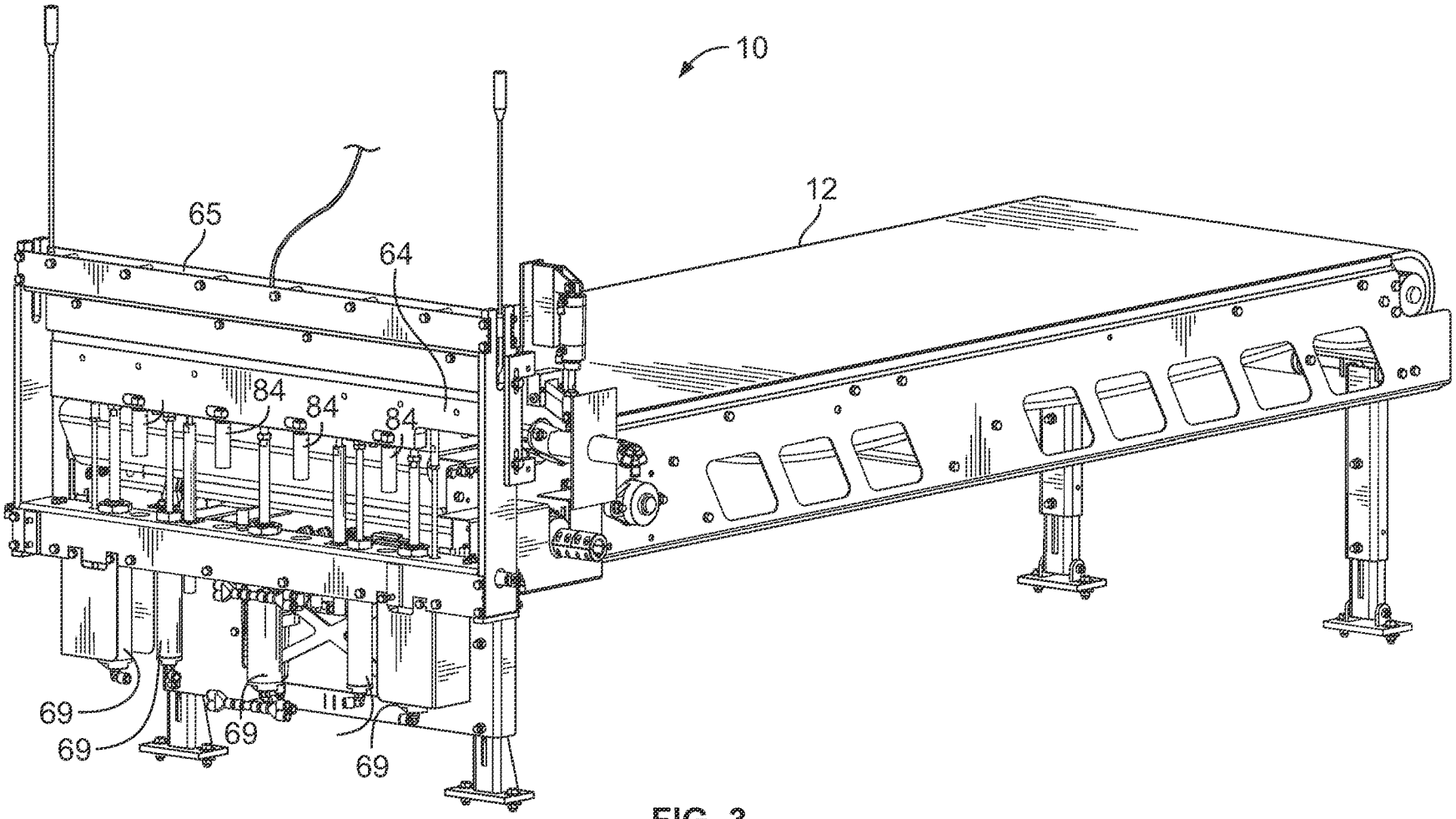
FIG. 3 is a perspective view of the components shown in FIG. 2, with the dividing sealer lower support of the dividing sealer shown as deployed upward for sealing.
Figure 4A:
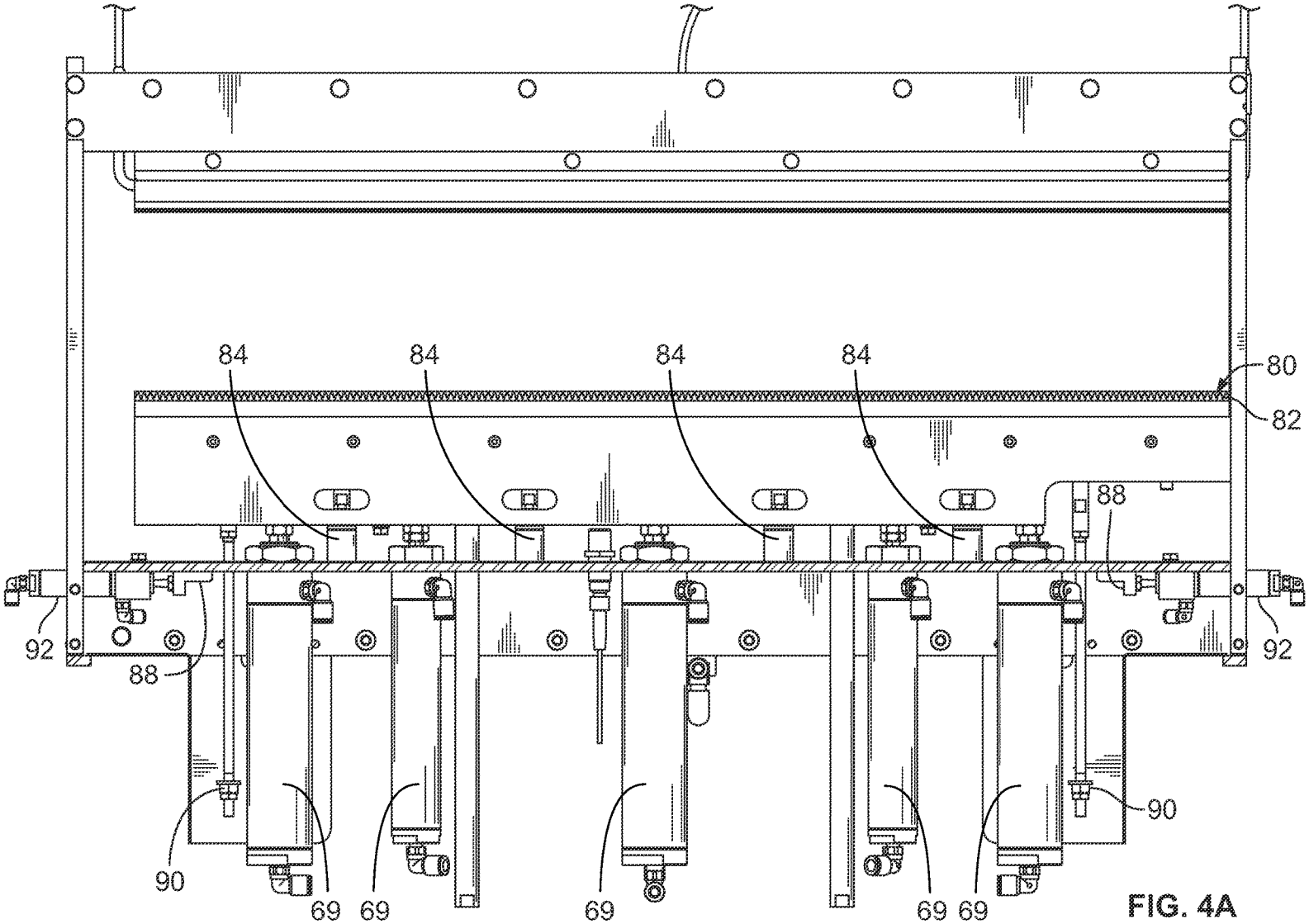
FIG. 4A is a front elevation view of the dividing sealer shown in FIG. 2.
Figure 4B:
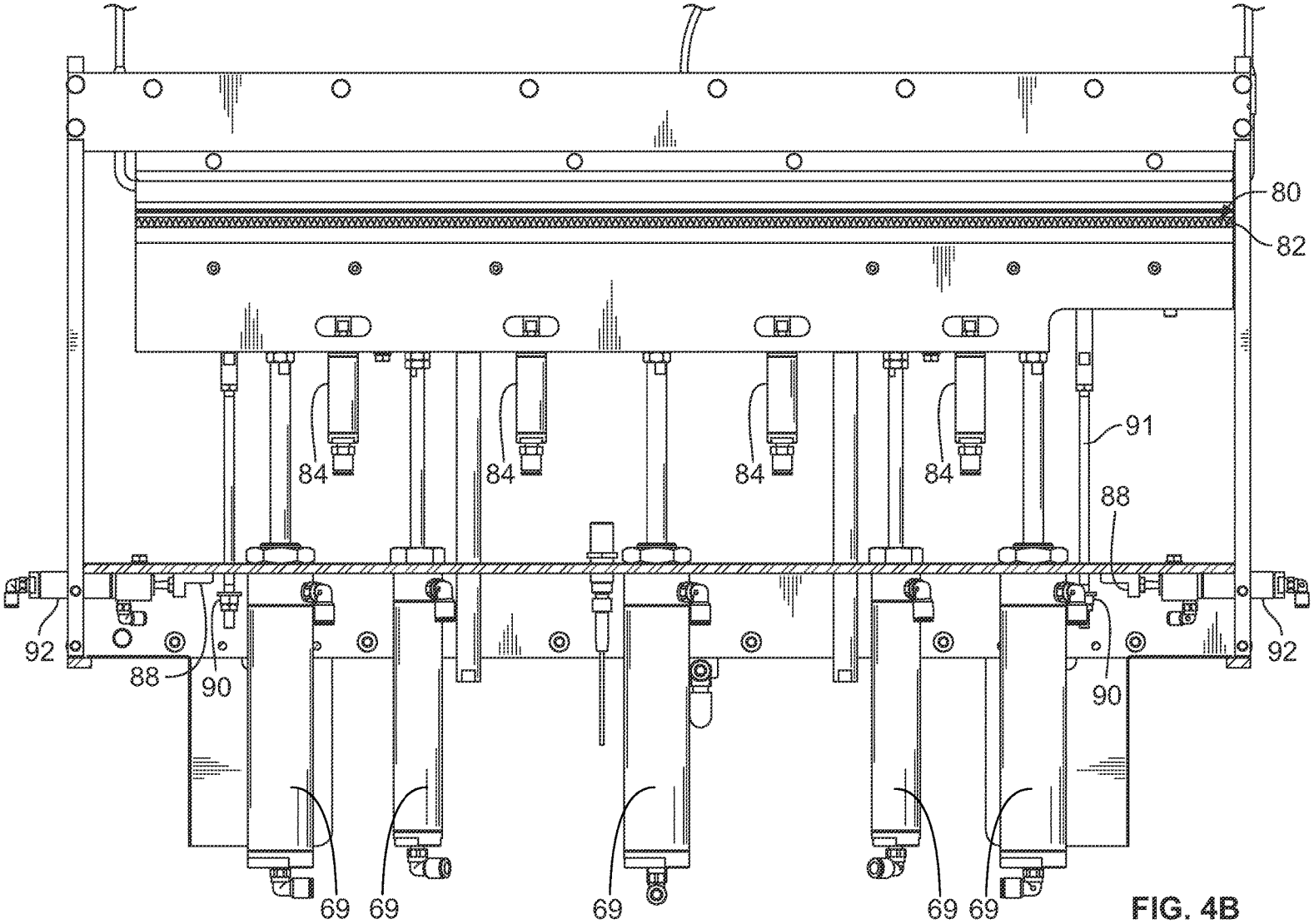
FIG. 4B is a front elevation view of the dividing sealer shown in FIG. 2, deployed for sealing only.
Figure 4C:
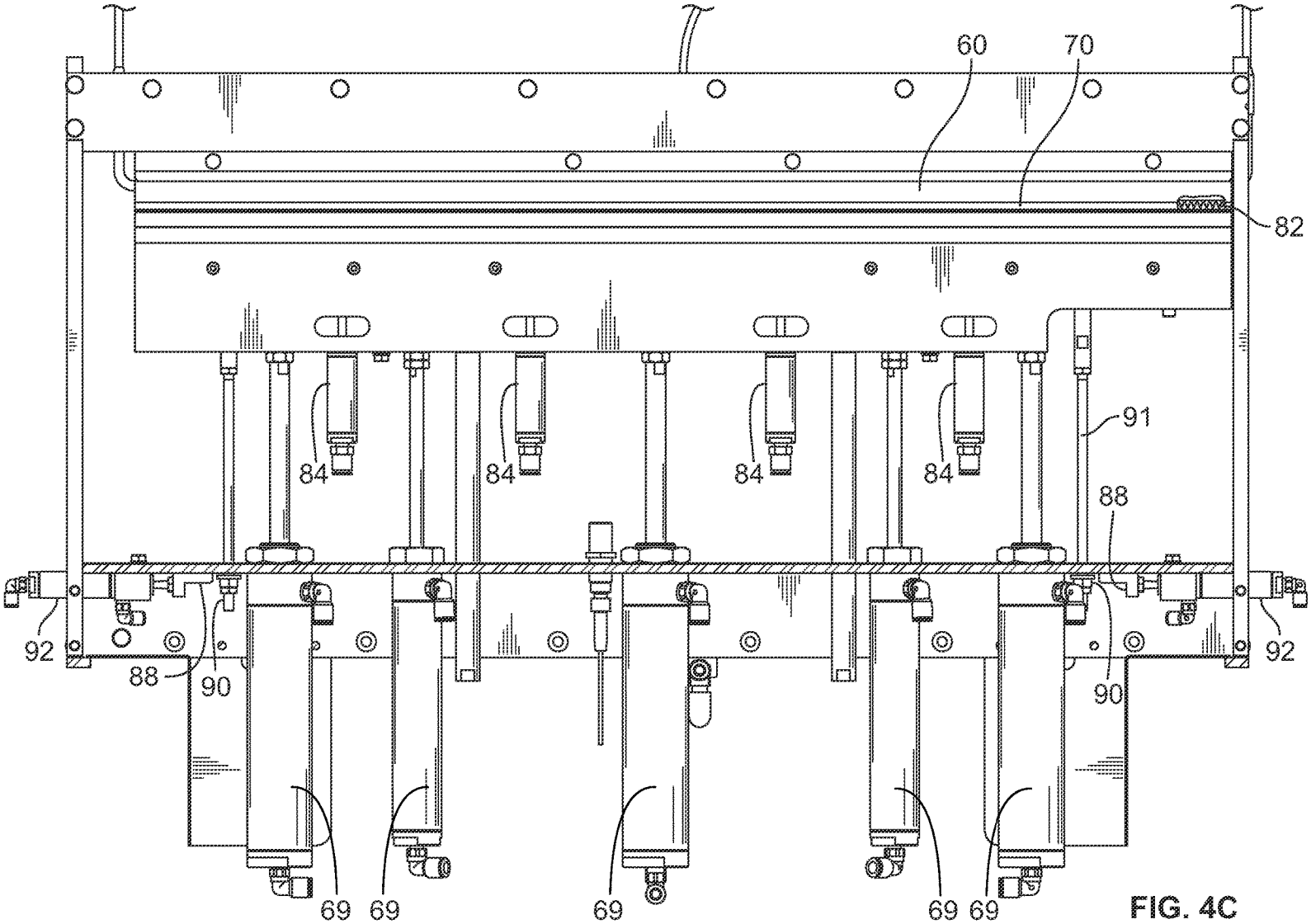
FIG. 4C is a front elevation view of the dividing sealer shown in FIG. 2, deployed for sealing and cutting.
Figure 4D:
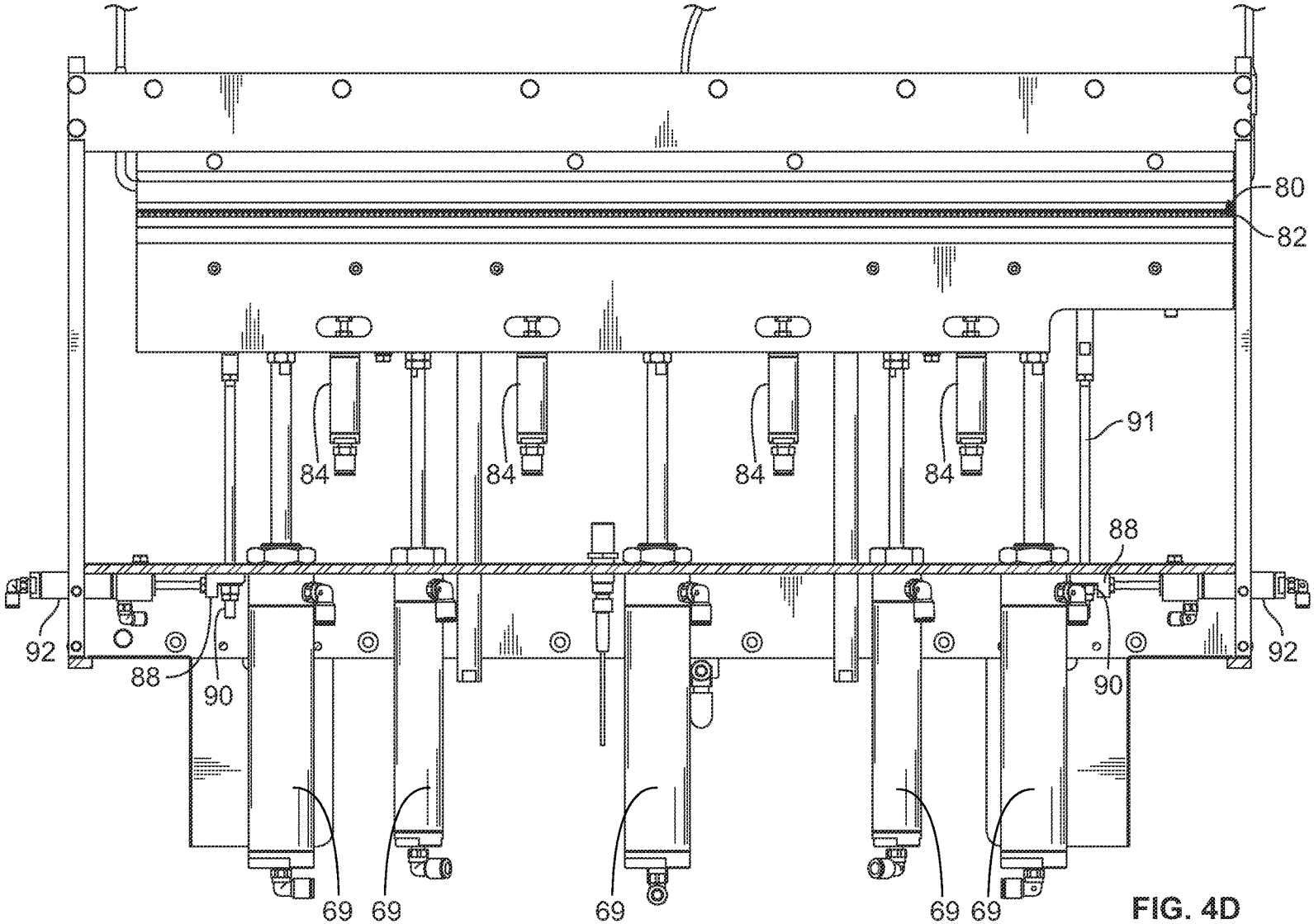
FIG. 4D is a front elevation view of the dividing sealer shown in FIG. 2, deployed for sealing and perforation.
Figure 4E:
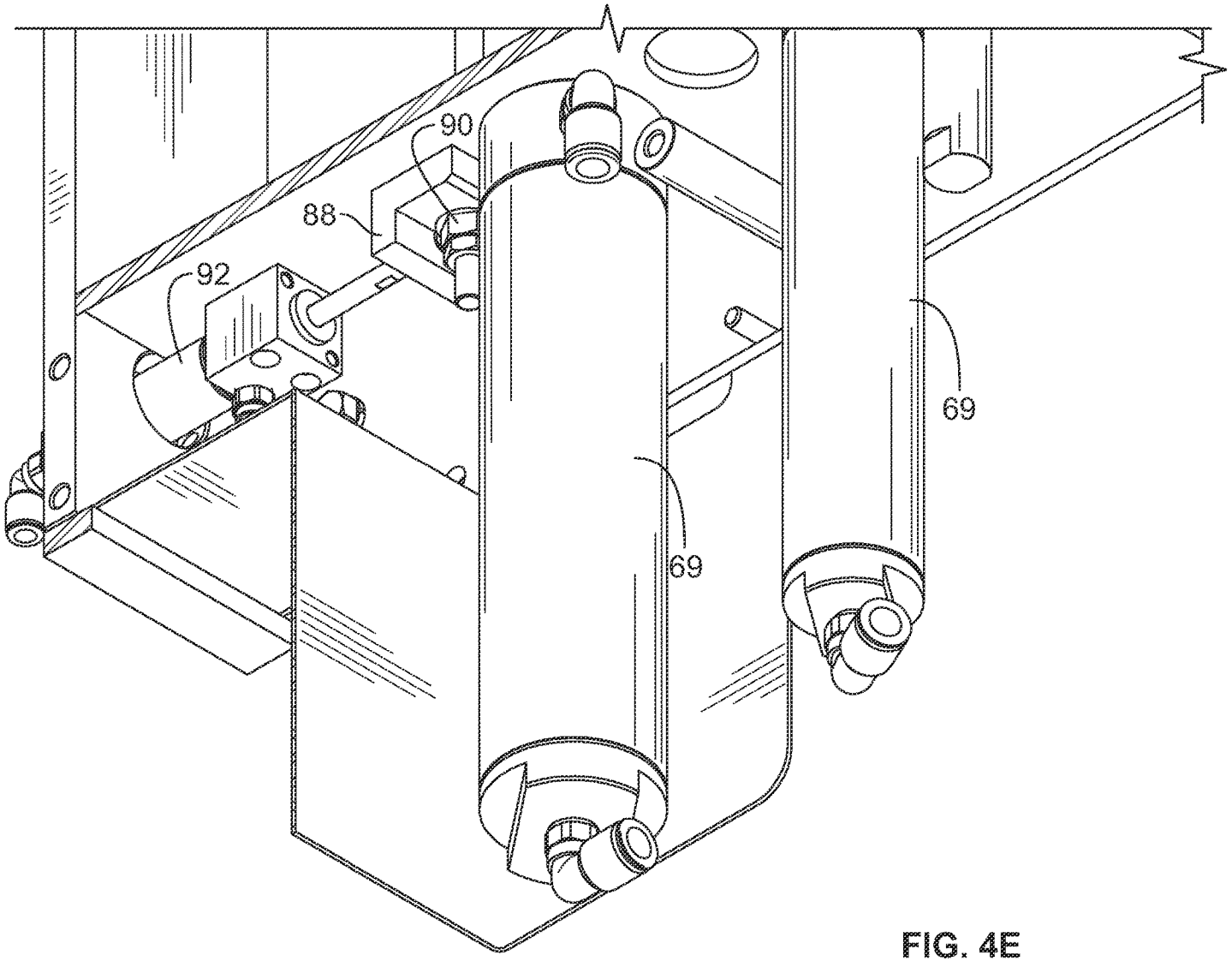
FIG. 4E is a bottom perspective detail view of a stop yoke for limiting extension of a knife rod of the dividing sealer shown in FIG. 2 to a perforation position.

In the illustrated embodiment, each interconnected flexible bag 22 formed in web 20 has a distal folded edge 26 and side seals 25, as shown in FIGS. 1A and 1B. Side seals 25 are preferably heat sealed by edge perforator-sealer 28, since flexible bag 22 is preferably constructed of plastic material. Distal folded edge 26 is inherently impermeable to the atmosphere and thus the distal edge of web 20 need not be heat sealed. As an alternative to distal folded edge 26, the distal edge of web 20 may comprise any suitable seal formed between two initially separate layers of material, which may for example be a heat seal or a cold adhesive seal, within the scope of the invention. A stationary shelf 32 provides a mounting surface for a resilient foot pad 37 against which a side edge sealing and cutting head 41 of edge perforator-sealer 28 is pressed to form side edge cuts and seals in the web.

To permit separation of adjacent flexible bags 22, the side edges of flexible bags 22 are cut along a side edge cut 30 that meets pre-perforation 27, pre-perforation 27 extending across a proximal longitudinal strip 31 of web 20 from a proximal end of side edge cut 30 to proximal edge 23 of web 20. Side edge cut 30 is preferably a complete cut rather than a perforation, thus eliminating the need for subsequent tearing along cut 30 to separate bags 22, while also permitting the edges of bags 22 to be displaced longitudinally inwardly and away from neighboring bags 22 when bags 22 are expanded vertically to accommodate trays T, thus avoiding undue stresses on web 20. Pre-perforation 27, on the other hand, is advantageously a discontinuous perforation rather than a complete cut, permitting proximal longitudinal strip 31 of web 20 to remain intact as it passes through apparatus 10, to facilitate simultaneous alignment of each bag 22 at its respective station of apparatus 10.

As shown in FIG. 1A, timing belts 35 and timing belt pulleys 36 are used to direct proximal longitudinal strip 31 of web 20 in a downline advancing web direction indicated by the arrow in FIG. 1A, through automatic packaging apparatus 10. Timing belts 35 are preferably used to maintain a gas-tight (permitting minimal or no gas leakage) seal with respect to each bag 22 that main web conveyor 12 moves in a downline direction from a gas flushing station 38 to a proximal sealing station 39. A gas-tight seal is promoted by minimizing any gap between the proximal end of side heat seal 25 and timing belts 35

Figure 8A:
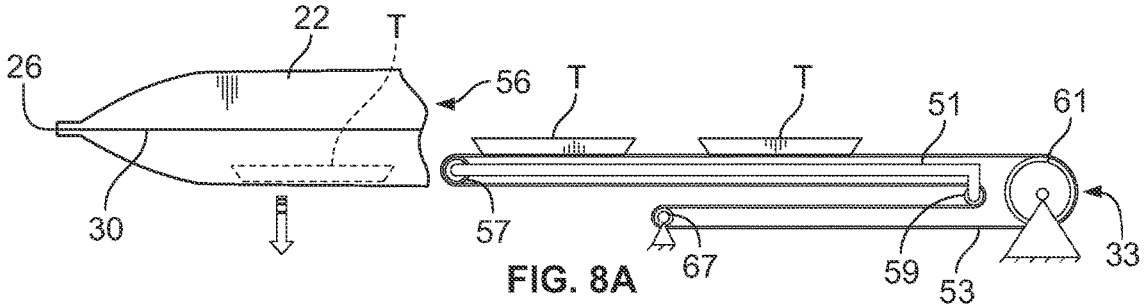
FIG. 8A is a schematic side elevation view of a vertically indexing bag and an infeed conveyor, after a first tray layer has been placed in the bag and before an indexing conveyor (not shown) has lowered the bag to receive a second tray layer from the infeed conveyor.
Figure 8B:
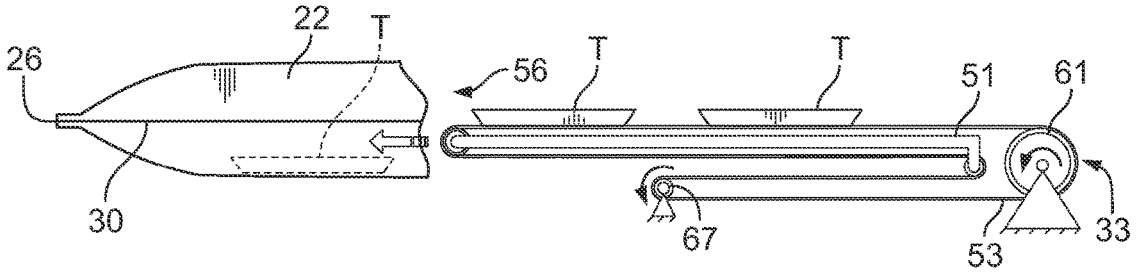
FIG. 8B is a schematic side elevation view of the vertically indexing bag and infeed conveyor of FIG. 8A after a downward bag indexing step.
Figure 8C:
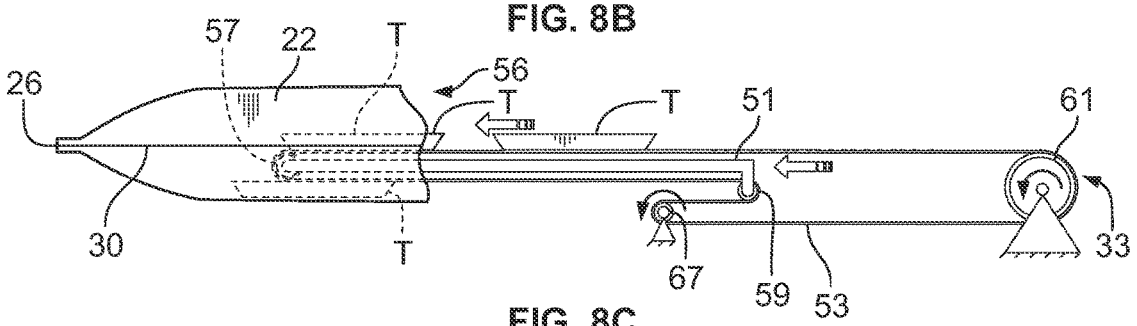
FIG. 8C is a schematic side elevation view of the vertically indexing bag and infeed conveyor of FIG. 8B as a second tray layer is being inserted.
Figure 8D:
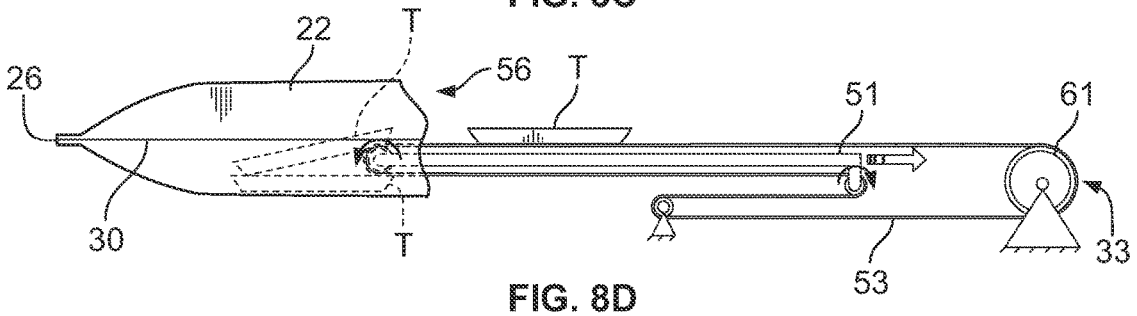
FIG. 8D is a schematic side elevation view of the vertically indexing bag and infeed conveyor of FIG. 8C as the second tray layer is being deposited in the bag and the infeed conveyor is being withdrawn.
Figure 8E:
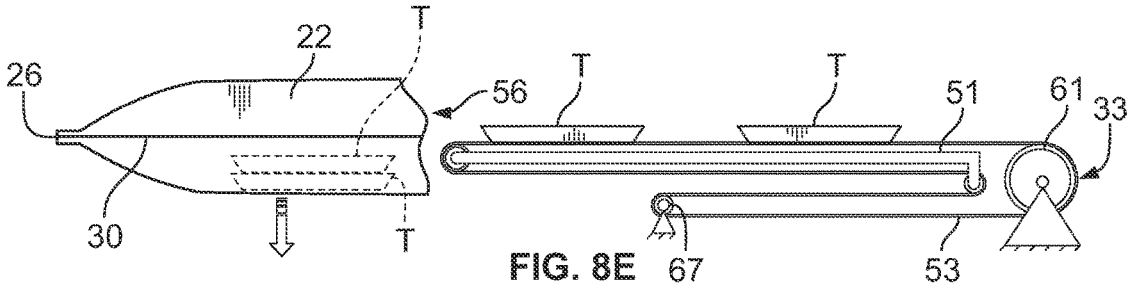
FIG. 8E is a schematic side elevation view of the vertically indexing bag and infeed conveyor of FIG. 8D after a second tray layer has been deposited and the infeed conveyor has been withdrawn, and before the indexing conveyor has lowered the bag to receive a third tray layer from the infeed conveyor.

A product infeed station 34 is configured to separate the layers of web 20 at an open proximal edge 23 of web 20 and bag 22 and insert a product to be packaged into bag 22. Products to be inserted into bag 22 are illustrated herein for simplicity as contained in trays T, but they could be provided with any other suitable form of pre-packaging, such as a wrapper or separator sheet, or no pre-packaging at all. Product infeed station 34 comprises a product infeed conveyor 33 for inserting trays T into flexible bag 22. As illustrated schematically in FIGS. 8A-8E, product infeed conveyor 33 supporting trays T moves toward bag 22 in a generally horizontal direction to insert a tray T and moves in a generally opposite horizontal direction to withdraw from bag 22. Product infeed conveyor 33 is illustrated as inserting itself into bag 22 together with a tray T, but other appropriate conveyor types which merely insert the product without inserting any conveyor structure into bag 22, such as upright pusher plates, gravity feed chutes, or the like, are within the scope of the invention. Where product infeed conveyor 33 is of a type that is inserted along with trays T, product infeed conveyor 33 may include an appropriate unloading mechanism for discharging a product inside bag 22 while some part of product infeed conveyor 33 is inside bag 22. Thus, in the illustrated example, product infeed conveyor 33 includes a product infeed boom 51 that is configured to advance and retract transversely with respect to bag 22, and an endless product supporting product infeed conveyor belt 53 that is movably supported relative to product infeed boom 51. Infeed conveyor belt 53 is looped around two traveling rollers 57 and 59, a drive roller 61, and a fixed passive roller 67 as depicted schematically in FIGS. 8A-8E. In this manner, product infeed boom 51 and drive roller 61 act in concert to advance a tray T supported on product infeed conveyor belt 53 to a position above a desired location inside bag 22. Product infeed boom 51 is then retracted without advancing drive roller 61, effectively pulling infeed conveyor belt 53 out from under tray T, so that tray T is discharged from the end of product infeed boom 51 and placed at the desired location inside bag 22, as illustrated in FIGS. 8C-8D.

Figure 7A:
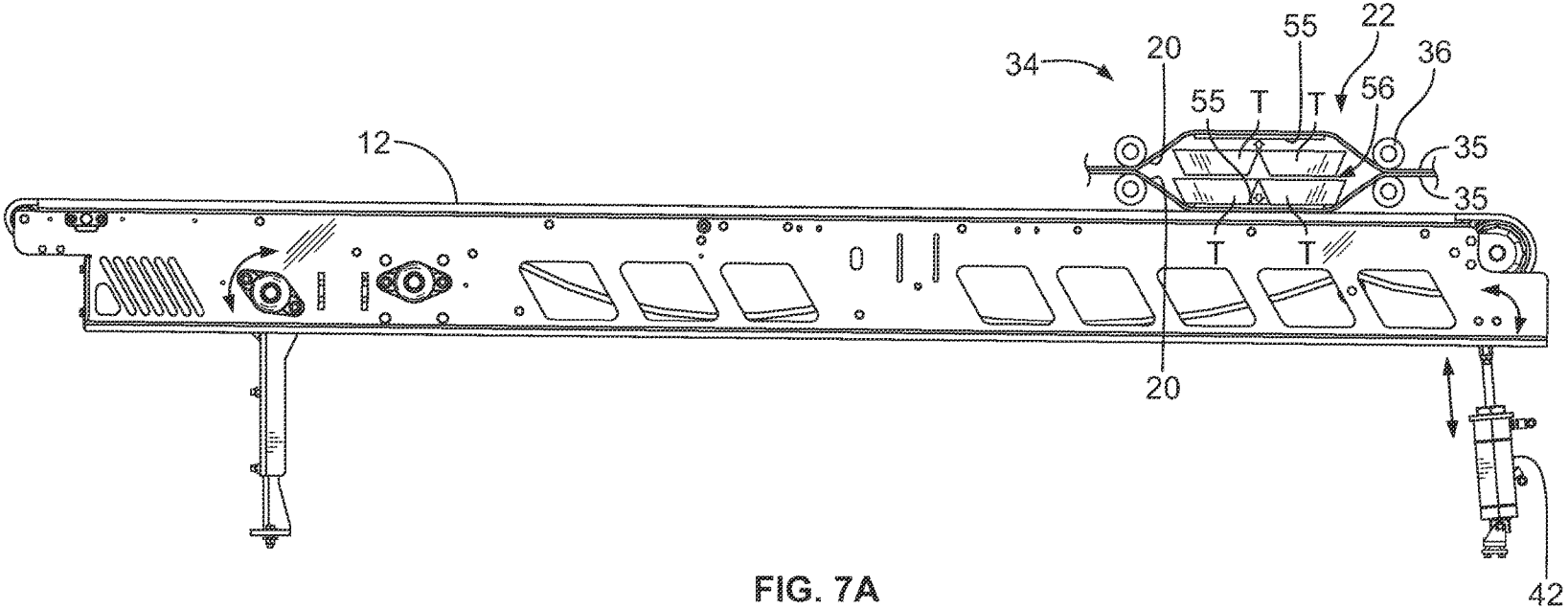
FIG. 7A is a side elevation view of a vertically indexing main conveyor and a tray infeed station according to an embodiment of a packaging apparatus according to the invention, for stacking trays in bags.
Figure 7B:
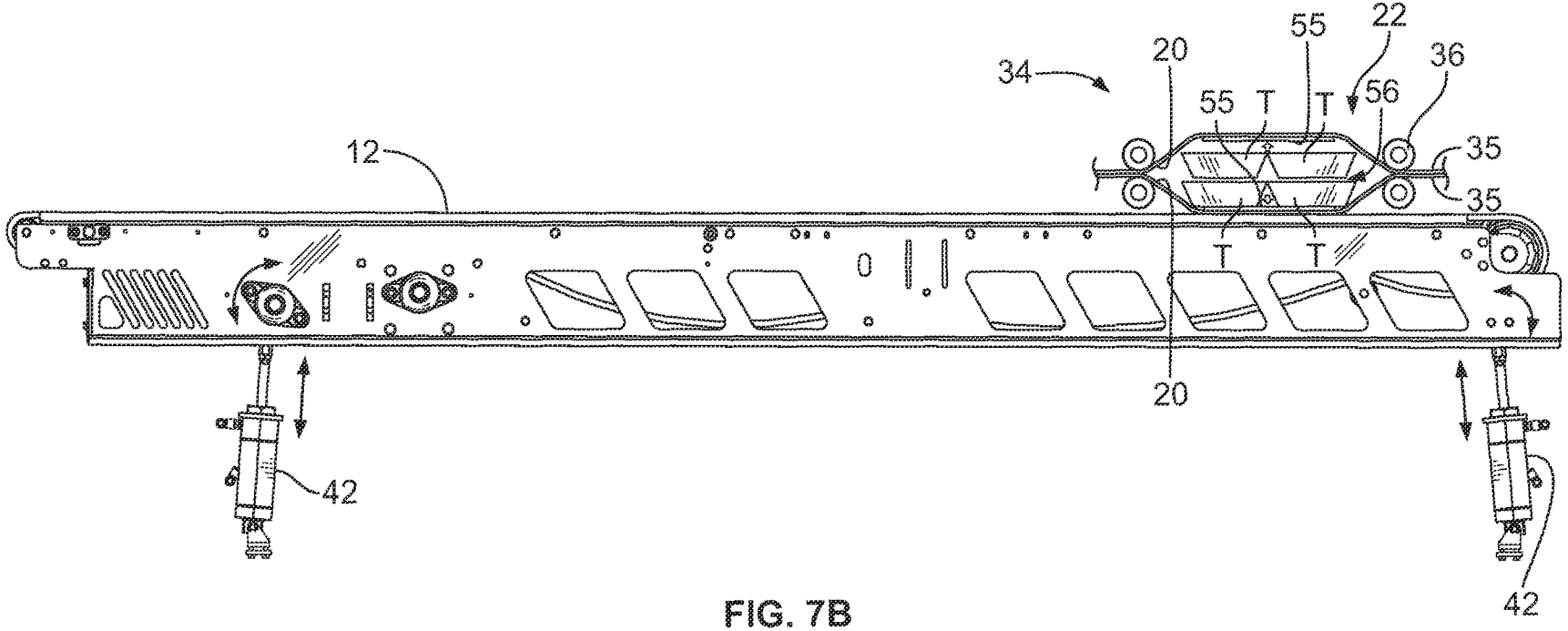
FIG. 7B is a side elevation view of another vertically indexing main conveyor and a tray infeed station according to another embodiment of a packaging apparatus according to the invention, for stacking trays in bags.

Product infeed station 34 preferably comprises a conventional spreader bracket 55, shown in FIG. 1A and represented schematically in FIGS. 7A and 7B, for separating the plies of flexible bag 22 to form an opening 56 for receiving tray T, as depicted schematically in FIGS. 7A, 7B, and 8A-8E. In particular, timing belts 35 and proximal longitudinal strip 31 of web 20 are routed around spreader bracket 55, and when a bag 22 is aligned with product infeed station 34, spreader bracket 55 opens to an expanded configuration for receiving tray T.

Turning again to FIGS. 8A-8E, a tray-stacking embodiment of apparatus 10 is illustrated schematically. According to this embodiment, product infeed conveyor 33 remains at a constant vertical position during successive insertion and return movements, while bag 22 is indexed downward by an appropriate vertical distance after an initial insertion stroke and before each of a predetermined number of successive strokes, to permit a next higher layer of one or more trays T to be inserted above the previous layer. In one example, four layers of trays T may be accommodated in this manner. As illustrated in FIGS. 7A and 7B, downward indexing movement of bag 22 to permit tray stacking may be provided, for example, by pivoting main web conveyor 12 downward while bag 22 is at product infeed station 34 using an appropriate mechanism such as a hydraulic cylinder 42 supporting an upline end of main web conveyor 12 (FIG. 7A). Alternatively, if main web conveyor 12 and web 20 need to be kept precisely level for even stacking of trays T and/or to avoid unintended effects of tilting main web conveyor 12 elsewhere along the packaging line, bag 22 may be indexed downward by vertically translating main web conveyor 12 downward using an appropriate mechanism such as hydraulic cylinders 42 supporting both an upline end and a downline end of main web conveyor 12 (FIG. 7B).

Once flexible bag 22 is supplied with a load, a controller is used to advance main web conveyor 12 in a downline direction. Flexible bag 22 is thus moved downline to a gas flushing station 38 where substantially all of the gas, typically primarily air, is drawn out of bag 22 by any appropriate suction implement, such as a snorkel 44 in fluid communication with a vacuum source, and a replacement gas supplying a desired modified atmosphere is injected by an appropriate implement, which may also be snorkel 44 in fluid communication with a pressurized gas source. Typical replacement gas mixtures may, for example, comprise about 0.4% carbon monoxide, about 30% carbon dioxide, and about 69.6% nitrogen, to provide a low- to no-oxygen modified environment in bag 22; or 80% oxygen and 20% carbon dioxide, to provide a high-oxygen modified environment in bag 22. The apparatus may include a plurality of pressurized tanks containing different desired gas mixtures, and programmable valves or throttles configured for supplying gas from a selected tank to a particular bag 22.

After the completion of gas flushing, flexible bag 22 is moved downline by main web conveyor 12 to proximal sealing station 39 where proximal edge 23 is sealed to form a proximal seal 54 (see FIGS. 1A, 1B), preferably by heat sealing with a proximal sealer 40, to form a gas-tight seal within flexible bag 22. Timing belts 35 advantageously maintain a gas-tight seal at open proximal edge 23 of each flexible bag 22 that main web conveyor 12 transports from gas flushing station 38 to proximal sealing station 39, thus maintaining the modified atmosphere within bag 22 that is created at gas flushing station 38 until open proximal edge 23 can be sealed closed.

After proximal seal 54 has been formed, bag 22 is advanced downline to a dividing seal station 58 including a dividing sealer 65. Dividing seal station 58 is configured to seal bag 22 across its transverse width at a position between its side seals to divide bag 22 into separately sealed subcompartments 63. Dividing seal station 58 includes a dividing seal bar 60, disposed above main web conveyor 12 just beyond its downline end 62; and a dividing sealer lower support 64, disposed below main web conveyor 12 just beyond its downline end 62. When bag 22 is at dividing seal station 58, dividing seal bar 60 is positioned between side seals 25 of bag 22, so that the downline side seal 25 and a downline portion 66 of bag 22 is located beyond downline end 62 of main web conveyor 12. Downline portion 66 is preferably supported on a takeaway conveyor 68 that indexes forward in synchronization with main web conveyor 12 and timing belts 35. In alternative embodiments, the positioning of dividing sealer 65 may vary depending on whether subcompartments of equal or differing sizes are desired.

Figure 5A:
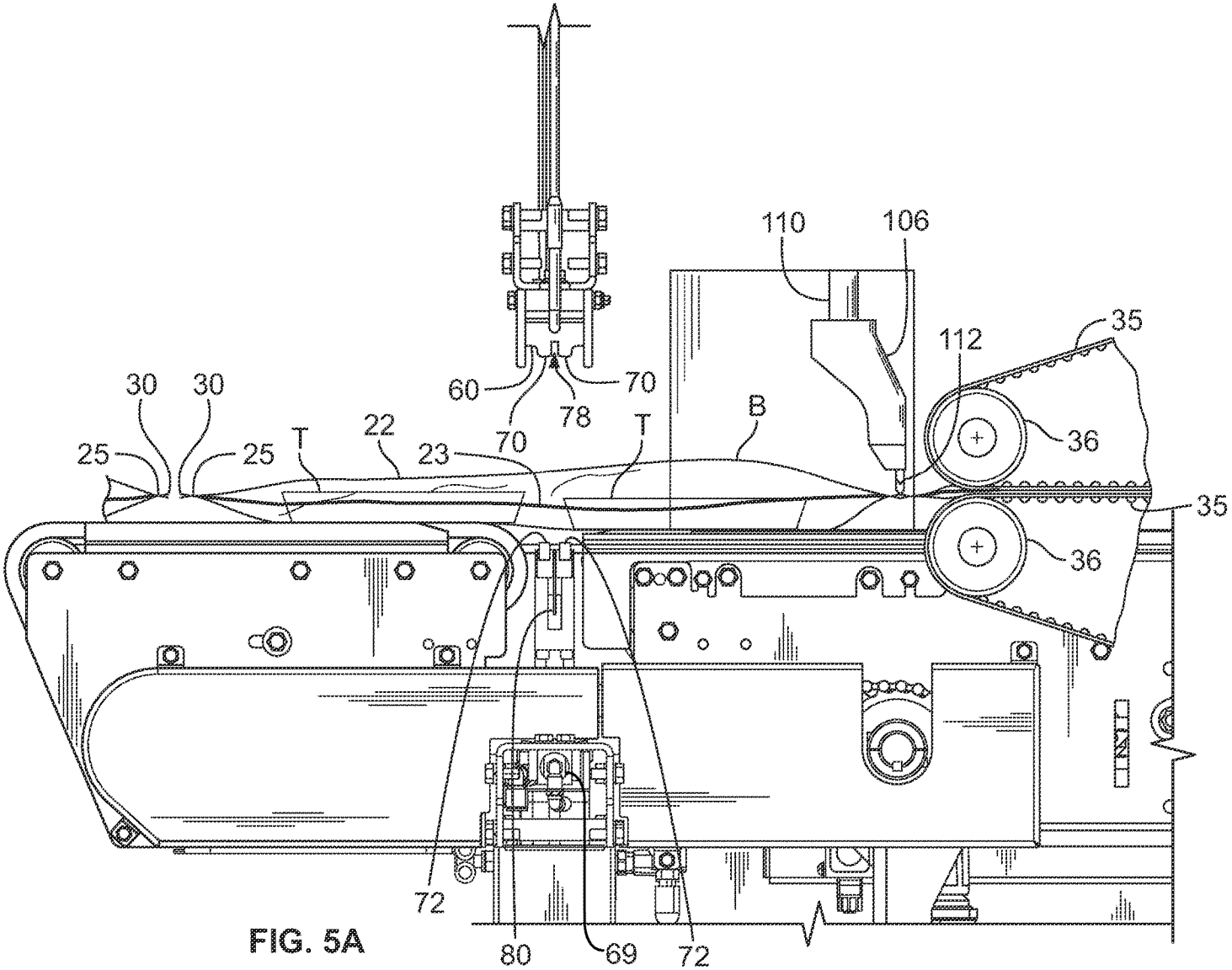
FIG. 5A is a side elevation view of a sealed bag at a dividing sealing station of the apparatus shown in FIG. 1 prior to gas settling.
Figure 5B:
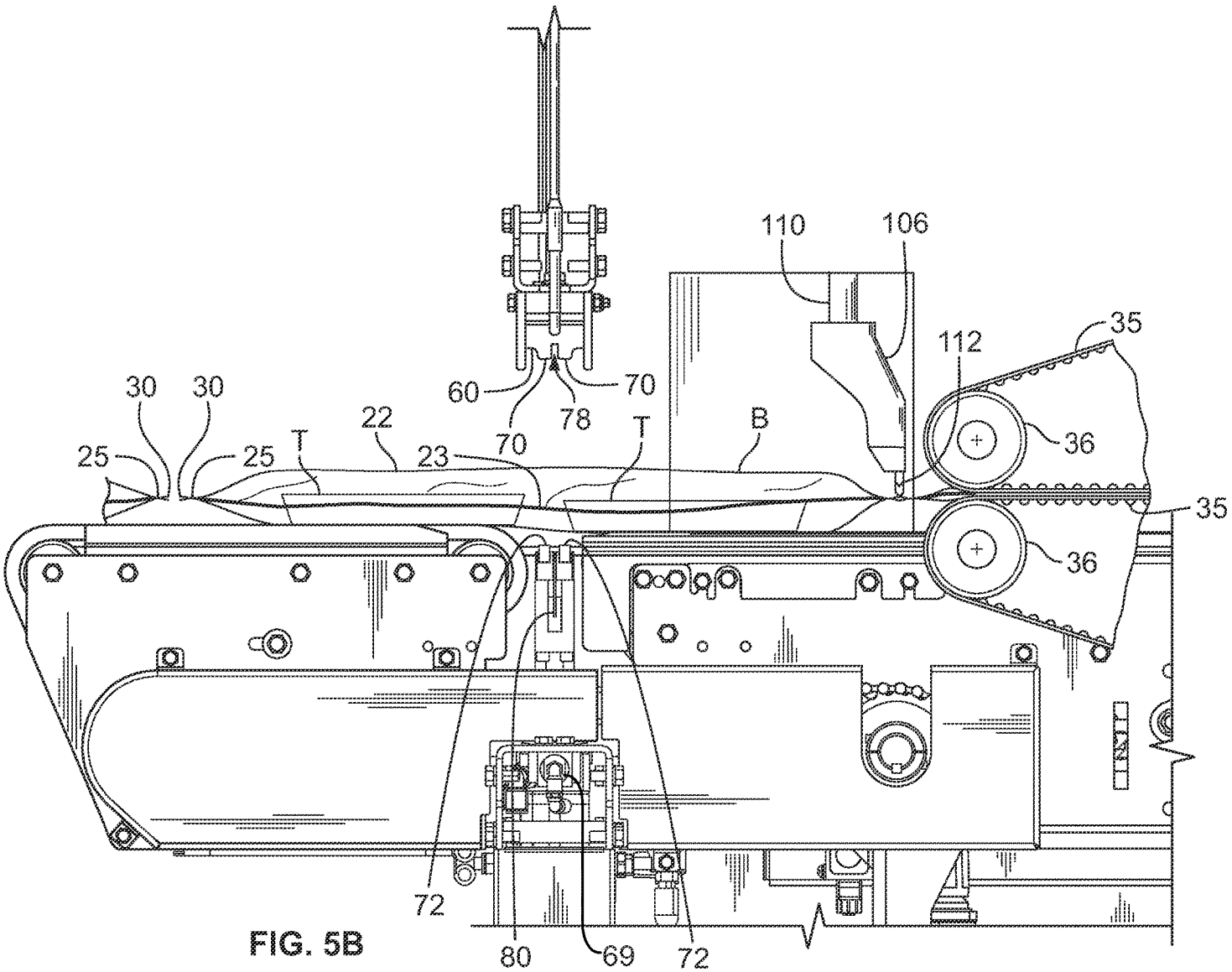
FIG. 5B is the side elevation view of the bag and dividing seal station shown in FIG. 5A, after a gas settling dwell time has passed.
Figure 5C:
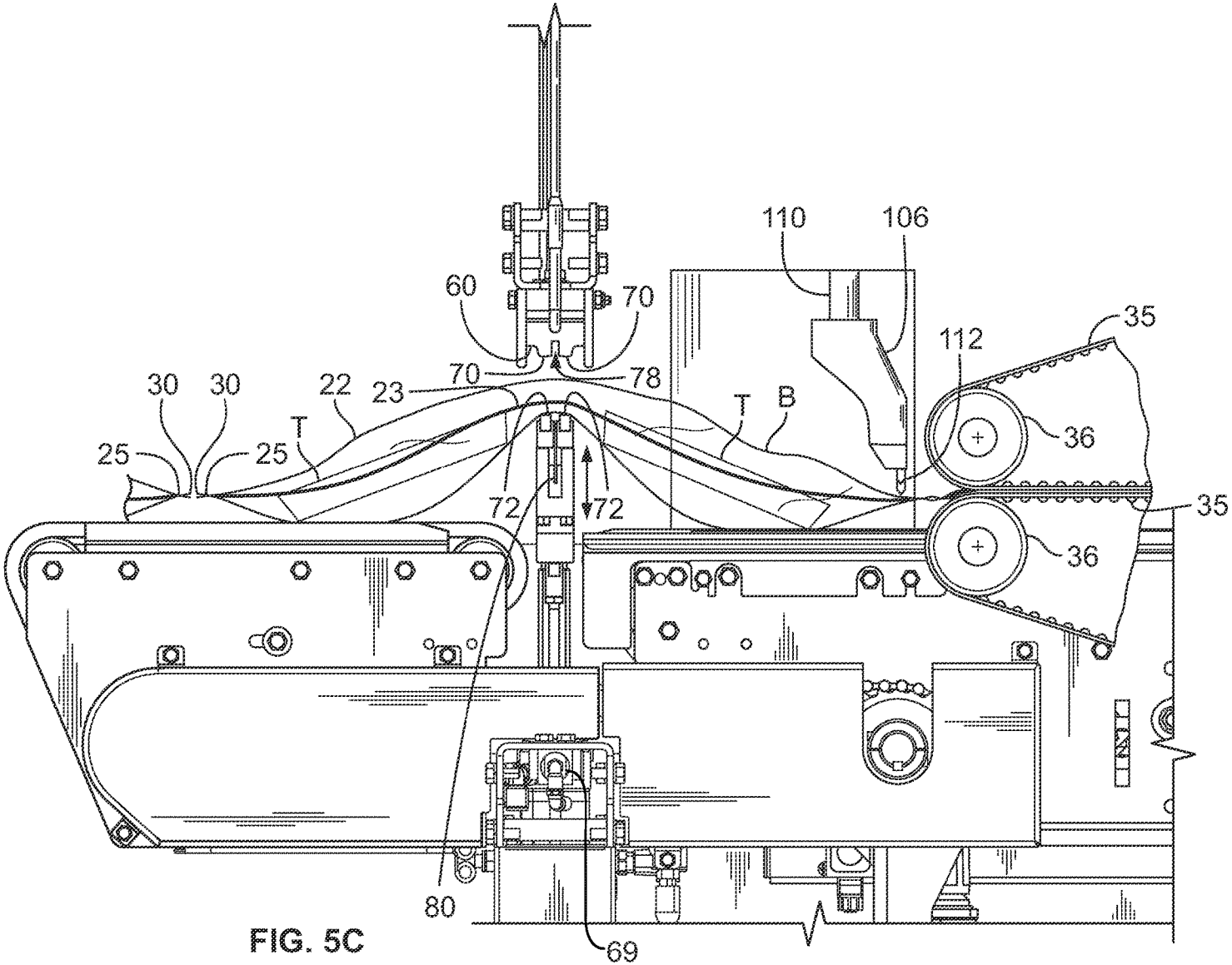
FIG. 5C is a side elevation view of the bag and dividing seal station shown in FIG. 5A, with a dividing sealer lower support partially raised and oscillating vertically.
Figure 5D:
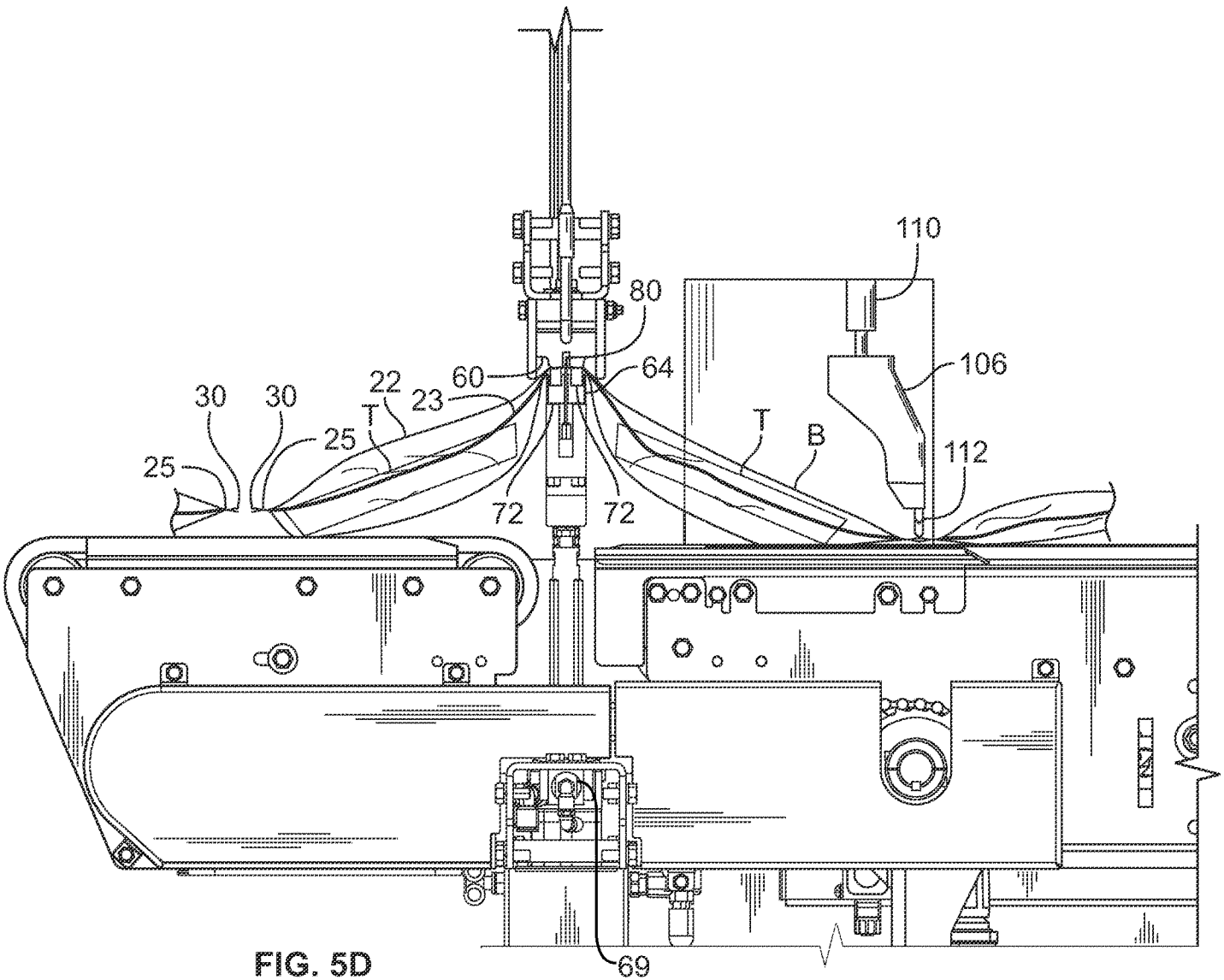
FIG. 5D is a side elevation view of the bag and dividing seal station shown in FIG. 5A, with the dividing sealer lower support fully raised to a sealing position gripping a central portion of the sealed bag against a heat seal bar, and a perforation breaker deployed to break the perforation between the sealed bag at the dividing seal station and an upline neighboring sealed bag.
Figure 9A:
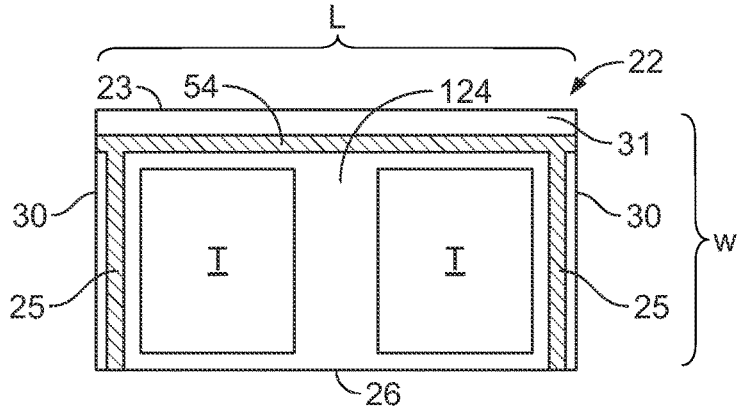
FIG. 9A is a schematic plan view of a sealed, single-compartment bag according to another aspect of the invention.
Figure 9B:
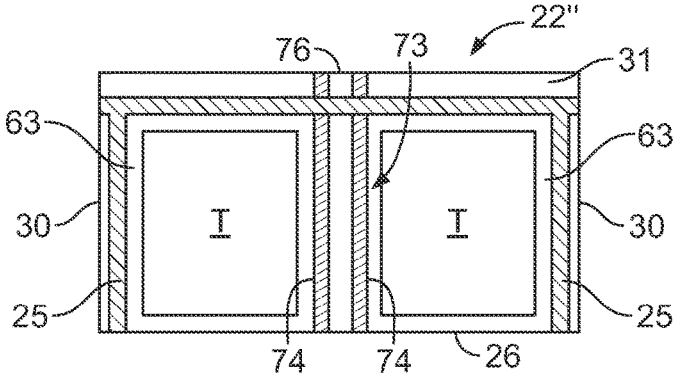
FIG. 9B is a schematic plan view of a sealed, dual-compartment bag according to another aspect of the invention.

In operation, dividing sealer lower support 64 is raised by pneumatic cylinders 69 (or other equivalent linear motive device, not shown) into engagement with dividing seal bar 60 to grip a central portion of bag 22 between dividing sealer lower support 64 and dividing seal bar 60 as depicted in FIGS. 5B-5D. Dividing seal bar 60 includes two longitudinally spaced apart, transverse heated bands 70 that engage respective longitudinally spaced apart, transverse seal compression members 72 to form a dividing seal 73 comprising similarly spaced sealed bands 74 extending transversely across bag 22 from distal folded edge 26 to proximal seal 54, having an unsealed band 76 of web material between them. Unsealed band 76 corresponds to a channel 78 in dividing seal bar 60 between traverse heated bands 70. Channel 78 is provided with sufficient depth to permit a bag splitting knife 80 to form a continuous cut along the full length of unsealed band 76 when bag 22 is retained between dividing sealer lower support 64 and dividing seal bar 60, without teeth 82 of bag splitting knife 80 impinging channel 78, thus avoiding unnecessary wear on teeth 82. Bag splitting knife 80, which has a continuous cutting edge defined by an array of adjacent, generally V-shaped teeth 82 as shown in FIG. 6A, is mounted in dividing sealer lower support 64 between traverse seal compression members 72 and is selectively deployed by separate pneumatic knife cylinders 84 that extend knife 80 from a home position relative to dividing sealer lower support 64 to a fully extended continuous cut position shown in FIG. 5D, to form a continuous center cut 86, resulting in splitting bag 22 into separate, smaller sealed bags 22', as shown in FIG. 9D. When it is desired instead to form a single, dual-compartment bag 22", as shown in FIGS. 1B and 9B, knife cylinders 84 are not deployed, and bag splitting knife 80 remains in its home position during center sealing.

Figure 9C:
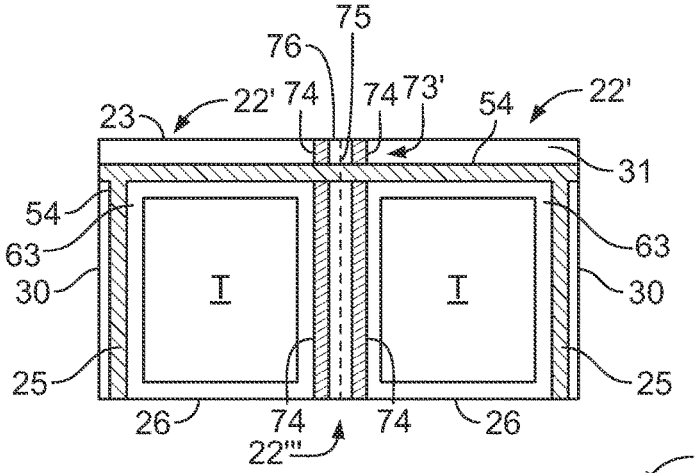
FIG. 9C is a schematic plan view of the dual-compartment bag of FIG. 9B with a perforation formed between the two compartments.
Figure 9D:
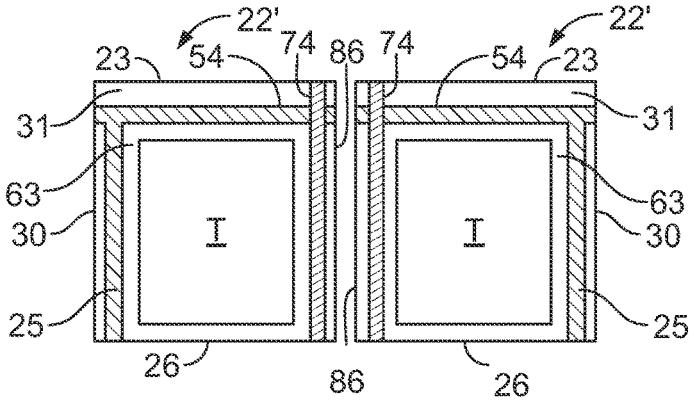
FIG. 9D is a schematic plan view of two separate single-compartment bags formed by applying a continuous cut between the center seal bands of the dual-compartment bag of FIG. 9B or by tearing along the perforation of the dual-compartment bag of FIG. 9C.

In still another mode, when it is desired to form a separable dual-compartment bag 22" comprising connected but manually separable smaller bags 22', as shown in FIG. 9C, bag splitting knife 80 may be deployed to a partially extended perforating position, in which only spaced-apart upper portions of center cut knife teeth 82 extend through the plies of web film along unsealed band 76. To avoid the need for a precisely calibrated burst of compressed gas supplied to knife cylinders 84 for perforation purposes, the vertical travel of knife 80 may instead be restrained by selectively engaging one or more knife stop yokes 88 in the path of one or more knife stop members 90 affixed to knife 80 by one or more stop rods 91. Each stop yoke 88 may itself by extended and retracted by any suitable motive device, such as a pneumatic cylinder 92.

Figure 6B:
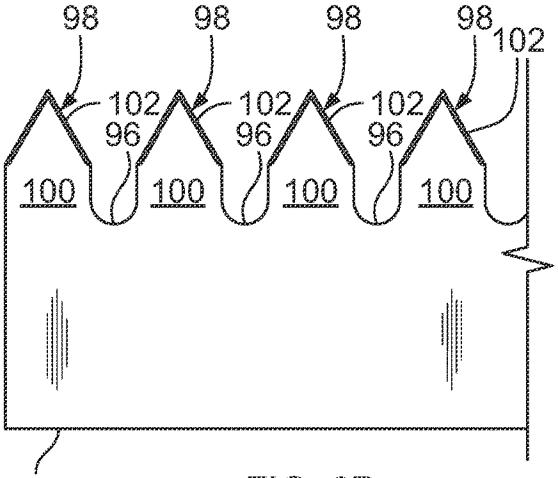
FIG. 6B is a side elevation view of a bag perforating knife for alternate use in the dividing sealer shown in FIG. 2.
Figure 6A:
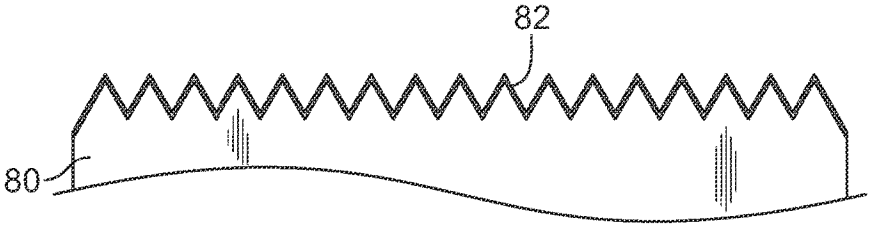
FIG. 6A is a side elevation view of a bag dividing knife for use in the dividing sealer shown in FIG. 2.

Alternatively, a transverse perforating knife 94 as shown in FIG. 6B may be used to form transverse perforations instead of continuous cuts. Transverse perforating knife 94 includes unsharpened gullets 96 spanning gaps between sharpened teeth 98, each of which in turn includes a uniform width base portion 100 extending below the ends of a respective sharpened edge 102. In this manner, penetration of transverse perforating knife 94 through a web film to any depth along the vertical length of base portion 100 will produce a perforation having essentially the same characteristic cut length and spacing between cuts. (A knife of this general shape may also be employed in pre-perforation assembly 24, which is not illustrated in detail.) However, stop yokes 88 are preferred for frequent switching between a continuous cut mode and a perforation mode, as they obviate the need to switch out one of bag splitting knife 80 and a transverse perforating knife 94 for the other in subsequent runs, thus lessening down time, as well as reducing the cost of the machine by making it possible to eliminate a perforating knife as a component.

Certain features and methods pertaining to dividing seal station 58 are provided to promote consistent compartment attributes and dividing seal quality. For instance, when bag 22 reaches dividing seal station 58, a gas bulge B may initially be present, due to inertia of the gas in bag 22 and the intermittent advancing movement of web 20. Thus, the raising of dividing sealer lower support 64 is preferably delayed by a dwell time predetermined to be sufficient to permit the gas inside bag 22 to settle evenly, promoting an even distribution of gas between subcompartments 63, as well as inhibiting ripples or misalignment the film material that could be caused by sealing when the web film material is being pulled in the direction of bulge B.

In addition, trays T may have a tendency to settle unevenly toward opposite ends of bag 22 when a central portion of bag 22 is lifted. This may be due to one or more of a number of factors. For example, initial asymmetry in the respective positions of trays T may cause them to settle asymmetrically; that is, one or the other of trays T may be initially farther displaced from its respective end of bag 22, closer to proximal seal 54 or distal folded edge 26, or rotated to a different orientation than the other tray T when in the horizontal position, before dividing sealer lower support 64 is raised or linear and/or rotational sliding of trays T on the lower film layer of bag 22, for example, due to trays T sliding in different ways during the intermittent starts and stops of web 20 between product infeed station 34 and dividing seal station 58. In addition, some part of one or both trays T may snag or hang up on a portion of film, or the web film material may have a steeper and/or more even incline from the central portion toward the downline side seal 25 than from the central portion toward the upline side seal 25 of bag 22, due to the upline side seal 25 being closer to the part of proximal longitudinal strip 31 of web 20 that is gripped between timing belts 35 at a position elevated above the top surface of main web conveyor 12. In accordance with the present invention, such tendencies of trays T to settle unevenly to their respective ends of bag 22 are overcome by dividing sealer lower support 64 oscillating up and down through a range of vertical positions elevated above the surfaces of main web conveyor 12 and takeaway conveyor 68, tending to free trays T from possible snags and allow them, as well as the gases in bag 22, to settle fully and evenly. In this way, the formation of a straight, uniform dividing seal 73 is promoted, limiting the appearance of kinks, bends, or anomalies that may weaken or appear to weaken dividing seal 73. For a particular configuration of bag 22, the inventors have found that vertically oscillating a central portion of bag 22, by moving the top of dividing sealer lower support 64 between 2 inches and 5 inches above the support surfaces of main web conveyor 12 and takeaway conveyor 68 for 3 cycles at 5 Hz, consistently provides even settling of trays T to promote a substantially uniform dividing seal 73. Specifically, these results were achieved for a bag 22 formed of 0.002-in thick polynylon film having a 26.4-inch length L along the direction of web travel and a 30-inch width/bag depth w perpendicular to web travel (as indicated in FIG. 9A), trays T measuring approximately 8.6 in.×6.5 in.×1.2 in., and each tray T containing approximately 1 pound of product.

With reference to FIGS. 5C and 5D, separation of neighboring bags 22, by breaking proximal longitudinal strip 31 of web 20 along pre-perforation 27, may advantageously be performed by a perforation breaker 106 while a bag 22 is retained between dividing sealer lower support 64 and dividing seal bar 60. At this stage, a portion of proximal longitudinal strip 31 of web 20 including the location of pre-perforation 27 is tensioned between dividing seal station 58 and timing belts 35, so that pre-perforation 27 may be readily broken by actuating perforation breaker 106 to press a perforation breaking tip downwardly against and through pre-perforation 27. Perforation breaker 106 may be actuated by a gas cylinder 110 or any other suitable motive device, and a suitable perforation breaker tip may be a dull implement (e.g. flat or rounded) or may preferably be a sharp implement 112. Sharp implement 112 helps perforation breaker 106 to catch, pull, and tear off even a relatively slackened downline portion of proximal longitudinal strip 31 of web 20, permitting perforation breaker 106 to function whether or not dividing sealer 65 is gripping a bag 22. Many other configurations of perforation breaker 106 are possible; e.g., perforation breaker 106 in an inverted orientation could apply an upward breaking stroke to a bottom side of pre-perforation 27, or an alternative perforation breaker could apply a breaking stroke including angular movement in addition to or instead of purely linear movement. Or instead of applying a transverse stroke unilaterally, another alternative breaker could break pre-perforation 27 by gripping and longitudinally pulling proximal longitudinal strip 31 of web 20 from the downline side of pre-perforation 27, instead of applying transverse pressure to proximal longitudinal strip 31 of web 20 at the approximate location of pre-perforation 27.

Figures 5E, 5F:
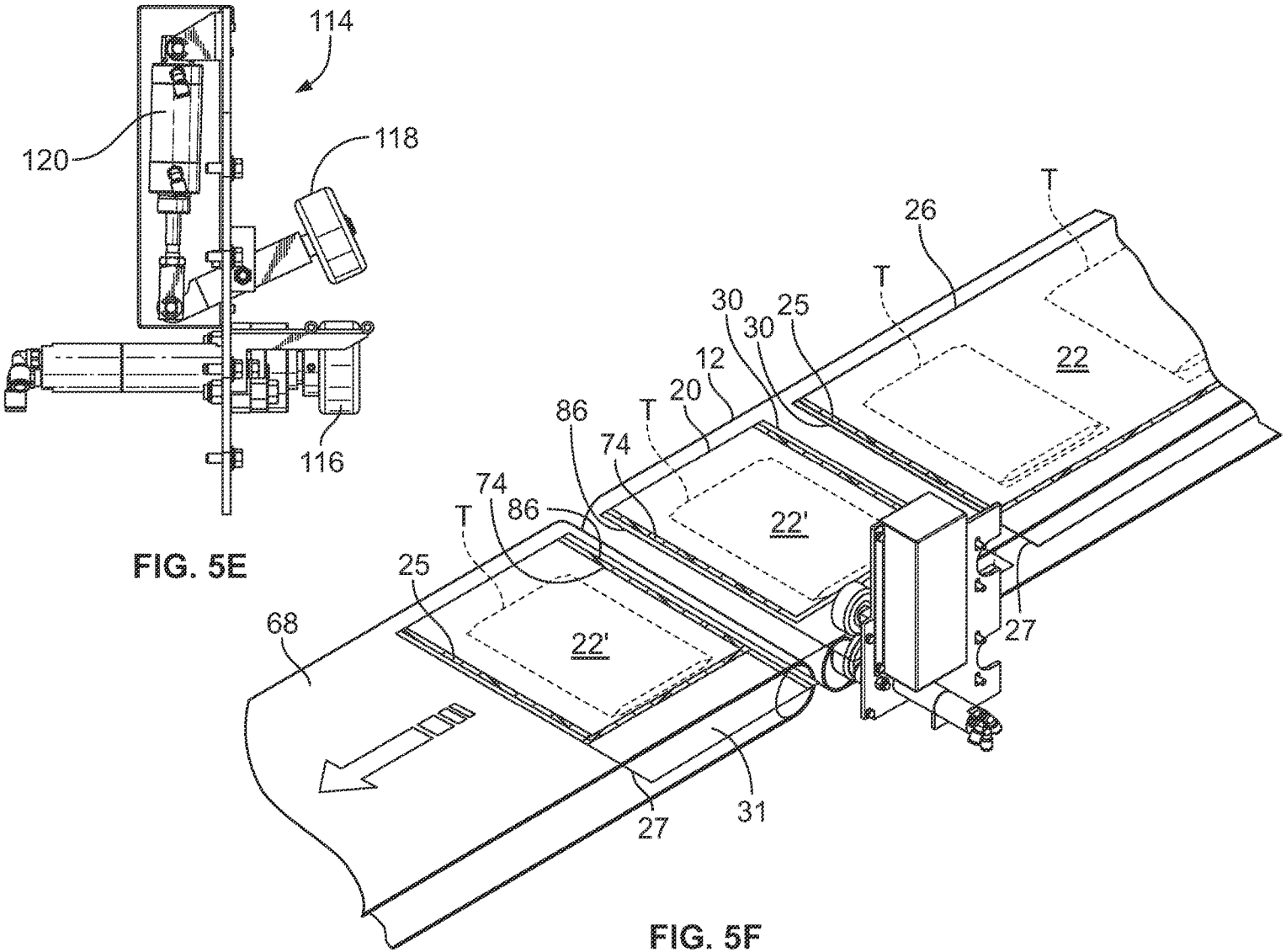
FIG. 5E is a side elevation view of an alternative perforation separating mechanism.
FIG. 5F is a simplified perspective view of the alternative perforation separating mechanism shown in relation to a web of bags, main conveyor, and takeaway conveyor of the device of FIG. 1.

One example of a gripping and pulling type of perforation breaker is illustrated in FIGS. 5E and 5F as a tear-off roller assembly 114, including a fixed-axis motor driven lower roller 116 and a movable-axis upper roller 118. An actuator cylinder 120 alternately brings the rollers together to grip a portion of proximal longitudinal strip 31 of web 20 downline of pre-perforation 27 and supply a pulse of rotation frictionally pulling proximal longitudinal strip 31 of web 20 to tear off a bag 22 that has advanced past timing belts 35, and moves the rollers apart to permit web 20 to freely advance between successive tear-offs. Tear-off roller assembly 114 can be particularly useful on runs of apparatus 10 in which splitting or compartmentalizing a sealed bag is not desired, and thus dividing sealer 65 will not be deployed to grip and tension bag 22 between dividing sealer 65 and timing belts 35, so that mere application of a transverse force to one side of pre-perforation 27 may be insufficient to break pre-perforation 27. (When a dividing seal is to be applied to a bag 22, tear-off roller assembly 114 would execute its tear-off operation before dividing sealer lower support 64 is raised, to avoid upper roller 118 getting in the way of the raising and lowering of bag 22 by dividing sealer lower support 64, as might occur if bag 22 is still connected to web 20.) However, as noted above, perforation breaker 106 equipped with a sharp implement 112 is also generally capable of breaking perforations without the help of longitudinal tension, while having the advantage of a simpler design than that of tear-off roller assembly 114.

Turning now to FIGS. 9A-9D, different configurations of sealed bags which may be formed by apparatus 10 are illustrated, as mentioned above. Each configuration has certain advantages. Shown in FIG. 9A is a sealed bag 22 lacking a dividing seal and defining a single sealed compartment 124 containing trays T in a modified atmosphere. A sealed bag 22" of another type is shown in FIG. 9B, including an imperforate dividing seal 73 dividing bag 22" into permanently joined (i.e., not easily separable by hand) separately sealed subcompartments 63, permitting the opening and consumption of the contents of one subcompartment 63 while maintaining the modified atmosphere of the other subcompartment 63 undisturbed, for prolonged freshness. Another configuration is the perforated dual-compartment bag 22'" shown in FIG. 9C, in which a perforated dividing seal 73', having a perforation 75 extending along unsealed band 76 between sealed bands 74, permits subcompartments 63 to be held together for shipping and handling, optionally further packaged or labeled as a unit, and/or sold as a unit to the consumer, while permitting subcompartments 63 to be manually separated when convenient for a downline supplier or the consumer to do so, to form separate bags 22'. For example, the consumer may desire to separate an opened one of subcompartments 63 from a still sealed subcompartment 63, to avoid contamination of the latter with food residue from the former.

In one embodiment, an electronic controller (not shown) is operatively connected to unwind motor 16, main web conveyor 12, timing belt pulleys 36, pre-perforation assembly 24, edge perforator-sealer 28, product infeed station 34 (including product infeed conveyor 33 and spreader bracket 55), gas flushing station 38 (including, for example, any linear actuators for extending and retracting snorkels or other hose attachments, and any gas supply and vacuum valves), proximal sealing station 39 (including heating and linear actuation of proximal sealer 40), dividing seal station 58 (including actuation of pneumatic cylinders 69, knife cylinders 84, and stop yoke cylinders 92 and heating of dividing seal bar 60), and takeaway conveyor 68. The control system causes unwind motor 16, main web conveyor 12, timing belt pulleys 36, and takeaway conveyor 68 to intermittently advance web 20 and bags 22 by an incremental distance approximately equal to a width (i.e., longitudinal dimension) of bag 22, and while web 20 is stationary, causes the foregoing components to operate simultaneously on the corresponding portions of web 20 and the corresponding bags 22 that are positioned at their respective stations. Preferably, the control system includes a servo mechanism (not shown) by which main web conveyor 12, timing belt pulleys 36, and takeaway conveyor 68 are mechanically powered by a single motor and thus inherently synchronized.

While the invention has been described with respect to certain embodiments, as will be appreciated by those skilled in the art, it is to be understood that the invention is capable of numerous changes, modifications and rearrangements, and such changes, modifications and rearrangements are intended to be covered by the following claims.

What is claimed is:

1. A packaging apparatus comprising a pair of opposed belts configured to grip a portion of a longitudinal strip of a web of flexible material comprising interconnected bags between the opposed belts, the interconnected bags being joined together by the longitudinal strip, and each bag comprising (1) a continuous closure extending continuously between a downline closure end and an upline closure end and meeting the longitudinal strip at the upline closure end and the downline closure end, said closure ends being spaced apart longitudinally to define an opening of the bag extending between the closure ends and (2) upline and downline sides of the bag extending transversely across the web of flexible material from the respective upline and downline closure ends;

a bag-loading mechanism configured to insert a product load into one of the bags through said opening and deposit the product load inside said bag;

a web conveyor configured to at least substantially support a portion of the web located between the gripped portion and the continuous closure in a generally horizontal orientation and to advance said portion of the web downline as the opposed belts advance the longitudinal strip of the web downline;

a closure sealing station configured to seal said opening of the bag to form a sealed bag containing the inserted product load; and a dividing seal station disposed downline of the closure sealing station, the dividing seal station comprising a heat seal bar and a lower seal support oriented transversely to the web, the lower seal support configured to move from a lowered position disposed below the web conveyor to a raised position in which the lower seal support lifts a transverse central portion of the bag above said upline and downline sides of the bag to cause an upline portion of the inserted product load to fall away from the central portion of the bag towards the upline side of the bag and a downline portion of the inserted product load to fall away from the transverse central portion of the bag towards the downline side of the bag, and the heat seal bar and lower seal support configured to grip the transverse central portion of the bag between them at said raised position of the lower seal support to create a divider seal in said bag to produce a sealed upline subcompartment containing said upline product load portion and a sealed downline subcompartment containing said downline product load portion.

2. The packaging apparatus of claim 1, wherein said lower seal support oscillates vertically after raising to the raised position to promote separation of said upline and downline product load portions before engaging the heat seal bar to seal said bag central portion.

3. The packaging apparatus of claim 2 wherein said lower seal support oscillates three times after the raising to the raised position.

4. The packaging apparatus of claim 2 wherein said lower seal support oscillates vertically over an inch to promote the separation.

5. The packaging apparatus of claim 1, the heat seal bar comprising longitudinally spaced apart, parallel, transverse elongate heat seal bands, disposed to form longitudinally spaced apart, parallel, transverse elongate heat seals in said bag central portion; and the apparatus further comprising a bag splitting knife mounted for vertical movement between a lowered position and a raised cutting position extending between the heat seal bands, so that when the bag is retained between the heat seal bar and the lower seal support and the bag splitting knife is moved to the raised cutting position, the bag splitting knife forms a continuous transverse cut in an unsealed strip of the bag extending between the heat seals across a transverse dimension of the bag, to separate the downline subcompartment from the upline subcompartment.

6. The packaging apparatus of claim 5, the bag splitting knife being operatively connected to a pneumatic cylinder, so that the bag splitting knife can be discharged from the lowered position to the cutting position by a pneumatic impulse delivered to the pneumatic cylinder.

7. The packaging apparatus of claim 6, the bag splitting knife comprising a linear array of generally V-shaped teeth, each tooth of the array comprising a tip and a cutting edge tapering from the tip to a base wider than the tip, the cutting edges of the teeth meeting end-to-end at the bases of the teeth to form a continuous cutting edge of the bag splitting knife.

8. The packaging apparatus of claim 7, further comprising a bag splitting knife stop member movable between a disengaged position and an engaged position obstructing movement of the bag splitting knife from a raised perforating position, in which an upper portion of each tooth penetrates the unsealed strip to form a perforation comprising a plurality of discontinuous cuts spaced apart along the unsealed strip, to the raised cutting position, the raised perforating position being disposed at an elevation between the lowered position and the raised cutting position, so that when the bag splitting knife stop member is in the engaged position, the bag splitting knife can be discharged from the lowered position to the perforating position by a pneumatic impulse delivered to the pneumatic cylinder and is restrained from passing the perforating position by the bag splitting knife stop member.

9. The packaging apparatus of claim 1, further comprising a bag separation tool configured to press against a portion of said longitudinal strip connecting the bag gripped between the seal bar and the lower seal support to an adjacent upline bag to separate the adjacent bags.

10. The packaging apparatus of claim 9, further comprising a pre-perforation knife adapted to form a perforation extending across the longitudinal strip to an end of each pair of adjacent free side edges of adjacent bags, before the longitudinal strip is fed between the opposed belts, said bag separation tool configured to separate the longitudinal strip along said perforation by pressing against said perforation.

11. A packaging apparatus comprising a programmable electronic controller;

a web of flexible material comprising interconnected bags;

a pair of opposed belts gripping a portion of a longitudinal strip of the web of flexible material between the opposed belts, the interconnected bags being joined together by the longitudinal strip, and each bag comprising (1) a continuous closure extending continuously between a downline closure end and an upline closure end and meeting the longitudinal strip at the upline closure end and the downline closure end, said closure ends being spaced apart longitudinally to define an opening of the bag extending between the closure ends and (2) upline and downline sides of the bag extending transversely across the web of flexible material from the respective upline and downline closure ends;

a web conveyor configured to at least substantially support a portion of the web located between the gripped portion and the continuous closure in a generally horizontal orientation and to advance said portion of the web downline as the opposed belts advance the longitudinal strip of the web downline;

a bag loader configured to insert a generally horizontally oriented first item into one of the bags between said opposed belts through said opening at a loading height and deposit the first item inside said bag; and a web conveyor lift mechanism configured to lift and lower the web conveyor underneath the location where the first item is deposited;

the electronic controller being programmed to cause the web conveyor lift mechanism to lower the web conveyor after the first item is deposited to lower the first item, and to cause the bag loader to insert a generally horizontally oriented second item into said bag at said loading height and deposit the second item on top of said first item in said bag.

12. The packaging apparatus of claim 11, said opposed belts being configured to advance the gripped web portion downline to guide top and bottom plies of the web around a spreader bracket at a product infeed station, the spreader bracket configured to expand to spread apart the plies of the longitudinal strip by a vertical gap to permit said first item and said second item to be inserted through said vertical gap.

13. The packaging apparatus of claim 12 further comprising a gas flushing station for replacing the gas in said bag, the gas flushing station downline of the product infeed station.

14. The packaging apparatus of claim 11 further comprising a gas flushing station for replacing the gas in said bag, the gas flushing station downline of the the location where the first item is deposited.

* * * * *